US007794043B2

(12) United States Patent
Nagata et al.

(10) Patent No.: US 7,794,043 B2
(45) Date of Patent: Sep. 14, 2010

(54) INK JET RECORDING HEAD AND INK JET RECORDING APPARATUS

(75) Inventors: Shingo Nagata, Kawasaki (JP); Nobuyuki Matsumoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/343,732

(22) Filed: Dec. 24, 2008

(65) Prior Publication Data

US 2009/0174741 A1 Jul. 9, 2009

(30) Foreign Application Priority Data

Dec. 26, 2007 (JP) ..... 2007-334467

(51) Int. Cl.
*B41J 2/165* (2006.01)
*B41J 2/21* (2006.01)

(52) U.S. Cl. ..... 347/22; 347/43

(58) Field of Classification Search ..... 347/12–13, 347/24, 35, 42
See application file for complete search history.

(56) References Cited

U.S. PATENT DOCUMENTS 5,659,342 A * 8/1997 Lund et al. ..... 347/35
6,659,583 B2 * 12/2003 Fujimori ..... 347/15
6,679,585 B2 1/2004 Kato et al.
6,976,748 B2 * 12/2005 Yabe et al. ..... 347/43
7,287,847 B2 10/2007 Fujii et al.

FOREIGN PATENT DOCUMENTS

JP 8-112904 5/1996

* cited by examiner

*Primary Examiner*—Matthew Luu
*Assistant Examiner*—Lisa M Solomon
(74) *Attorney, Agent, or Firm*—Fitzpatrick, Cella, Harper & Scinto

(57) ABSTRACT

An ink jet recording head includes a large nozzle array including a plurality of ejection outlets for ejecting ink and a small nozzle array including a plurality of ejection outlets, each having an opening area smaller than an opening area of ejection outlets of the large nozzle array. The ink jet recording head is mountable to an ink jet recording apparatus which is capable of causing the ink jet recording head to eject ink for a purpose of maintenance of the ink jet recording head without image formation on a recording material, the large nozzle array is supplied with light ink such as yellow, light cyan or light magenta ink, and the small nozzle array is supplied with dark ink such as cyan, magenta or black ink. The number of ejections of the dark ink is greater than the number of ejections of the light ink.

4 Claims, 12 Drawing Sheets

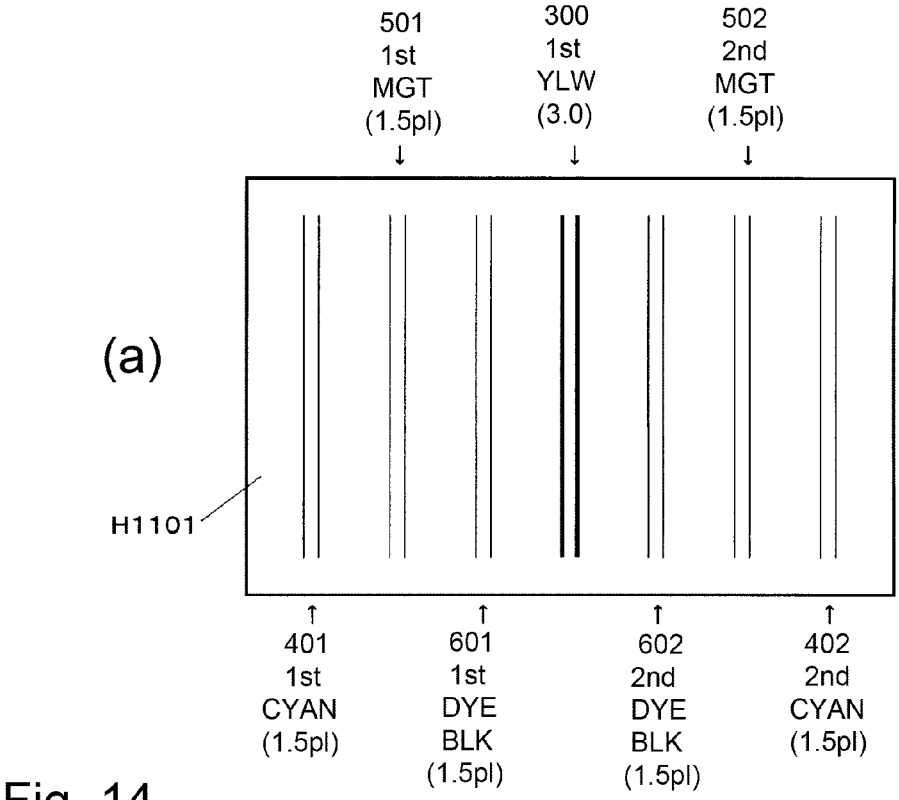
Fig. 14
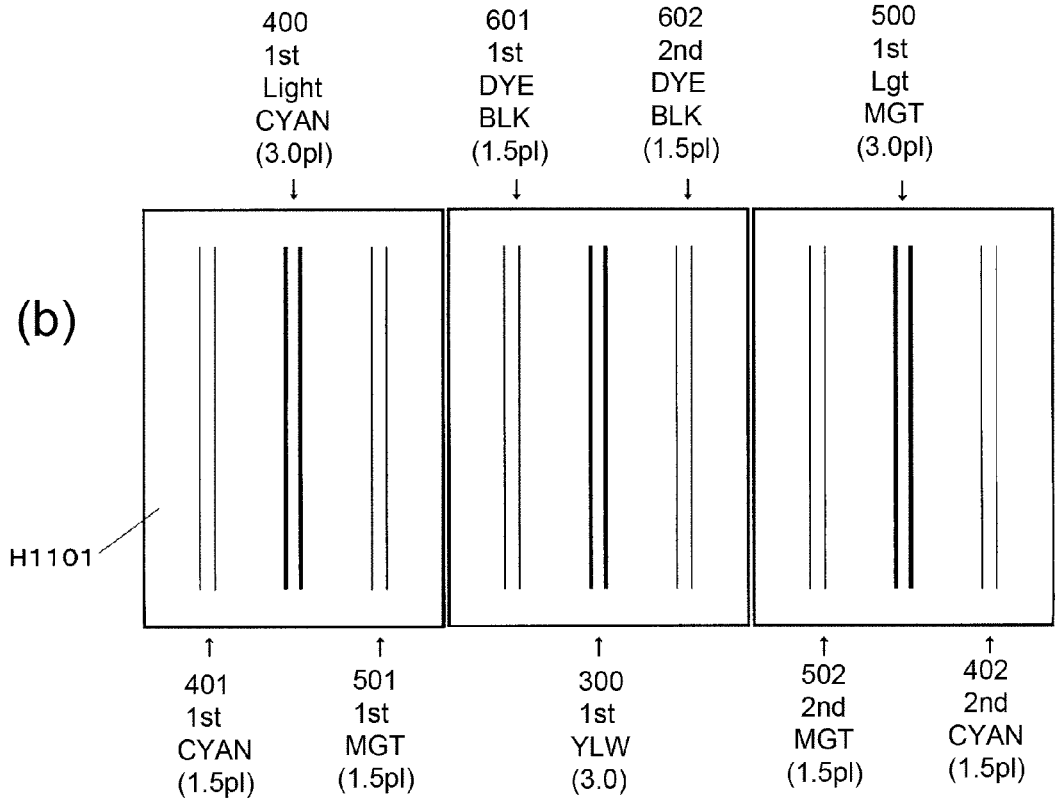

INK JET RECORDING HEAD AND INK JET RECORDING APPARATUS

FIELD OF THE INVENTION AND RELATED ART

The present invention relates to an ink jet recording head, and an ink jet recording apparatus employing an ink jet recording head.

A recording apparatus which uses an ink jet recording head is advantageous in that it is low in noise and operational cost. Further, the employment of an ink jet recording head makes it easier to reduce a recording apparatus in size, and also, to enable a recording apparatus to record in color. An image recorded with the use of an ink jet recording apparatus is made up of dots created by droplets of ink. Thus, in order to form a black-and-white image which is less grainy across its halftone areas, or a photographic color image which is less grainy across its halftone areas and high light areas, various attempts have been made to reduce an ink jet recording head (apparatus) in ink droplet size. Generally, the ink droplets jetted from recording heads for jetting color inks are 5 pl, 2 pl, etc., in volume (size), which are substantially smaller than the volume (roughly 15 pl) by which ink is jetted from an ordinary recording head for black-and-white printing. Further, in the recent years, not only have significant advancements been made in the field of digital input devices, but also, digital input devices have come to be widely used. Consequently, demands have been continuously increasing for ink jet recording apparatuses capable of printing a highly precise image, such as a photographic image, at a very high level of accuracy. Thus, it has become necessary to produce an ink jet recording head capable of jetting ink droplets which are as small as 1 pl in volume. Thus, it has become necessary to reduce an ink jet recording head in the size of the ink jetting opening of each of its nozzles.

The smaller the size of the ink jetting opening of each of its nozzles of an ink jet recording head, the greater the amount by which water evaporates from the body of ink in the nozzle, which is in the adjacencies of the opening, while ink is not jetted from the nozzle. Thus, the smaller the size of the ink jetting opening of each of its nozzles of the ink jet recording apparatus, the more likely the body of ink in each nozzle of the ink jet recording head to increase in viscosity, and therefore, the more likely the ink jet recording head to suffer from the problem that it fails to properly jet ink, because of the plugging of the nozzles by the body of the ink having increased in viscosity (ink droplets are jetted in an abnormal direction, and/or fail to reach recording paper). One of the conventional solutions to this problem is as follows. That is, an ink jet recording head was made to jet ink immediately before an ink jet recording operation is started, and/or with preset intervals during the recording operation, in such a manner that ink droplets land off the recording sheet. This operation hereafter may be referred to as "maintenance jetting". More specifically, an ink jet recording apparatus is provided with a waste ink absorbing member, which is located in the recording apparatus, or an opening dedicated to the reception of the ink jetted for maintenance. This operation is carried out as necessary, or with preset intervals. In the maintenance operation, several ink droplets —10 plus ink droplets— are jetted with an interval of roughly 2-15 seconds, although the number of ink droplets and the interval are adjusted according to the ink jetting force of an ink jet recording head in use, how quickly the inks in use lose their liquid content(s), and ambient temperature. In this maintenance operation, that is, the conventional maintenance operation, however, a recording head has to be moved to a preset location, for example, where the waste ink absorbing member is located. In other words, if this maintenance operation is carried out during a printing operation, that is, while images are formed on one or more sheets of recording paper, the recording head has to be moved out of the recording range of a sheet of recording paper, and therefore, the actual length of time available for printing images based on a unit of recording data (which hereafter will be referred to as throughput) becomes significantly shorter. This problem becomes exacerbated when an ink jet recording apparatus is operated in a high speed mode, in which the recording head is moved at the highest speed and highest capacity to minimize the length of time necessary per sheet of recording paper. In some cases, the ratio of the "maintenance jetting" amounts to a value as large as several percent to 10 plus percent.

To describe more concretely, it is assumed that an image is formed on a sheet of recording paper of A4 size (8"×11"), which is 20.32 cm×27.94 cm in printable area, and also, that each area of the image, which is equivalent to a single raster, is formed by a single scan of the recording sheet by the recording head in the widthwise direction of the recording sheet. In order to complete an intended image on the recording sheet of the abovementioned size, with the use a recording head, which is 5.33 mm (0.21 inch) in size and 5 pl in ink droplet size, and each column of nozzles of which has 256 nozzles aligned at a density of 1,200 dpi, the recording head has to scan the recording sheet roughly 52 times (number of times recording head has to scan recording sheet; number of times recording sheet has to be moved in its lengthwise direction). If the frequency at which the recording head is driven is 15 kHz, the moving (scanning speed) of the recording head is 63.5 cm (25 inches)/sec. Thus, assuming that the sum of the length of time necessary for moving the recording sheet in its lengthwise direction, and length of time necessary for the recording head to ramp up or down, is roughly 0.1 second, it takes roughly 0.52 second to complete an area of image, which is equivalent to a raster. Thus, the length of time necessary to complete an image on a single sheet of recording paper, which is A4 in size, is roughly 27 seconds. To roughly calculate the ratio of the maintenance jetting per page, if the interval for the maintenance jetting is 5 seconds, the number of times inks are jetted for maintenance per page is 5, which amounts to roughly 10% (=5 scans/52 scans) of the overall recording time. On the other hand, in the case of a recording head, which is smaller in ink droplet size, for example, 2 pl, the interval for the maintenance jetting has to be reduced to roughly 2 seconds. Thus, the ratio of the maintenance jetting, which is calculated in this case, using the same method as that described above, is roughly 25% (=13 scans/52 scans) of the overall recording time. In other words, the smaller the ink droplet size, the higher the rate of the maintenance jetting, and therefore, the lower the throughput.

As for the means for minimizing the problem that an ink jet head is reduced in throughput by the operation for maintaining the ink jet head, a means for reducing the need for carrying out an ink jetting operation dedicated to the maintenance of a recording head, is disclosed in Japanese Laid-open Patent Application H03-112904. According to this patent application, ink droplets, which are not intended for image formation, are jetted onto a sheet of recording paper while forming an image. More specifically, the ink droplets, which are not intended for image formation, are jetted onto the recording sheet so that they land on the areas of the sheet, which correspond to the edge portions of the image being formed, or, are jetted onto the recording sheet in a manner of effecting pseudo watermarks on the recording sheet.

All that is necessary to prevent the problem that a recording head is reduced in throughput by the operation for maintaining the recording head is to reduce the length of time necessary for the maintenance operation. One of the desired means for reducing the length of time necessary for the maintenance operation is to jet the ink droplets, which are intended for the maintenance, onto the recording sheet while forming an image, instead of moving the recording head to a preset location, away from the recording sheet, to carry out the maintenance operation.

The means disclosed in the abovementioned Japanese Laid-open Patent Application H08-112904is desirable in that the ink droplets for maintenance are jetted onto the recording sheet in such a pattern that the ink droplets land on the areas of the recording sheet, which correspond to the edge portions of the image being formed, or jetted in a manner of effecting pseudo watermarks on the recording sheet. This means, however, is not desirable in that the dots formed by the ink droplets jetted for maintenance are recognizable. Thus, this means is not desirable when forming a high quality image. Hence, it is desired to enable an ink jet recording head, in particular, an ink jet recording head for printing a highly precise image, such as a photographic image, to jet the ink droplets for maintenance, that is, the ink droplets which are not intended for image formation, onto a sheet of recording paper, without having ill effects on the image being formed. In order for the ink droplets jetted for maintenance to have no ill effects upon the image being formed, the dots formed by the ink droplets jetted for maintenance have to be as inconspicuous as possible. Thus, the object of the present invention is to ensure that the dots which will be formed on a sheet of recording paper by the ink droplets intended for maintenance will be as low as possible in visibility.

Obviously, the smaller the volume by which ink is jetted in the form of a droplet, the lower in visibility the dot formed by the ink droplet. Generally, however, the reduction in the ink droplet size of an ink jet recording head results in the reduction in the throughput of the ink jet recording head, unless the ink jet head is increased in the number of the ink droplets it can jet per unit length of time. One of the means for increasing the number of the ink droplets an ink jet recording head can jet is to increase the ink jet recording head in nozzle count. In order to increase an ink jet recording head in nozzle count, it is necessary to increase the ink jet recording head in size (chip size), which results in the increase in the cost of the ink jet recording head. That is, the relationship between the throughput of an ink jet recording head and the cost of the ink jet recording is a tradeoff. Therefore, it is important that the optimal ink droplet size for an ink jet recording head be determined in consideration of this relationship.

SUMMARY OF THE INVENTION

The primary object of the present invention is to provide an inexpensive ink jet recording head which is capable of forming high quality images at a significantly higher speed, while keeping at a significantly lower level in visibility, the dots formed on a sheet of recording paper by the ink droplets jetted for the purpose of maintaining the ink jet recording head, than any of the ink jet recording heads in accordance with the prior art.

Another object of the present invention is to provide an ink jet recording apparatus employing the ink jet recording head described above.

According to an aspect of the present invention, there is provided an ink jet recording head comprising a large nozzle array including a plurality of ejection outlets for ejecting ink; a small nozzle array including a plurality of ejection outlets each having an opening area smaller than an opening area of ejection outlets of said large nozzle array, wherein said ink jet recording head is mountable to an ink jet recording apparatus which is capable of causing said ink jet recording head to eject ink for a purpose of maintenance of ink jet recording head without image formation on a recording material, and wherein said large nozzle array is supplied with light ink consisting of yellow, light cyan or light magenta ink, and said small nozzle array is supplied with dark ink consisting of cyan, magenta or black ink, and wherein the number of ejections of the dark ink is larger than the number of ejections of the light ink.

According to another aspect of the present invention, there is provided an ink jet recording apparatus comprising an ink jet recording head according to the present invention of said aspect; and a controller for controlling an ejecting operation for the maintenance and an image forming operation.

According to the present invention, it is possible to provide an inexpensive ink jet recording head which is capable of forming high quality images at a significantly higher speed, while keeping at a significantly lower level in visibility, the dots formed by the ink droplets jetted for the purpose of maintaining the ink jet recording head, than any of the ink jet recording heads in accordance with the prior art, and also, an ink jet recording apparatus employing the ink jet recording head described above.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 14 is a plan view of the surface of the recording chip of the third embodiment of the present invention, as seen from the side where nozzle openings are located.

DETAILED DESCRIPTION OF THE PREFERRED EMBODIMENTS

Embodiment 1

Next, the first preferred embodiment of the present invention will be described with reference to the appended drawings.

First, a typical ink jet head cartridge (1), with which the present invention is compatible, and a typical ink jet recording apparatus (2) employing a typical ink jet head cartridge (1), will be described in detail.

(1) Recording Head Cartridge

FIGS. 1-8 are drawings for describing a preferable recording head cartridge (liquid jetting recording head cartridge), with which the present invention is compatible, the recording head portion thereof, and ink container portion for holding the ink (liquid) for recording, and also, their relationship, will be described. First, each of the above-mentioned structural components will be described with reference to the appended drawings.

Figure 1:
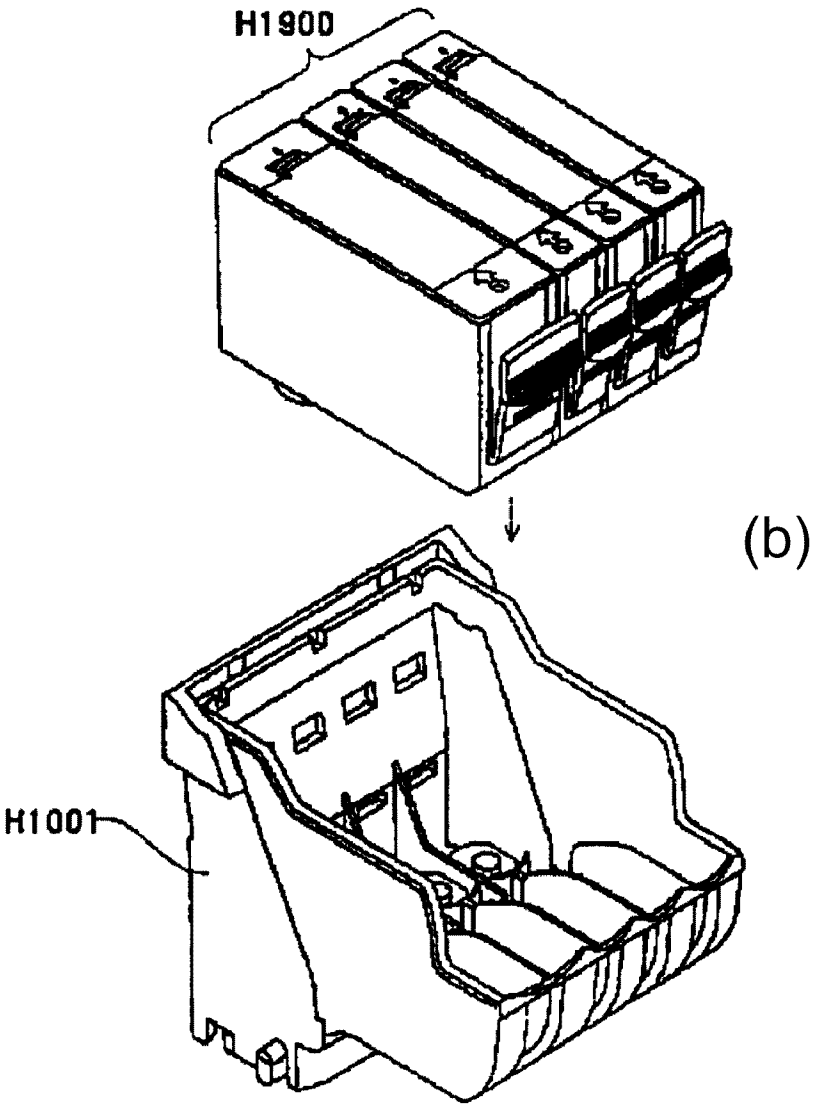
FIG. 1 is a perspective view of the recording head cartridge in the first embodiment of the present invention.
Figure 1:
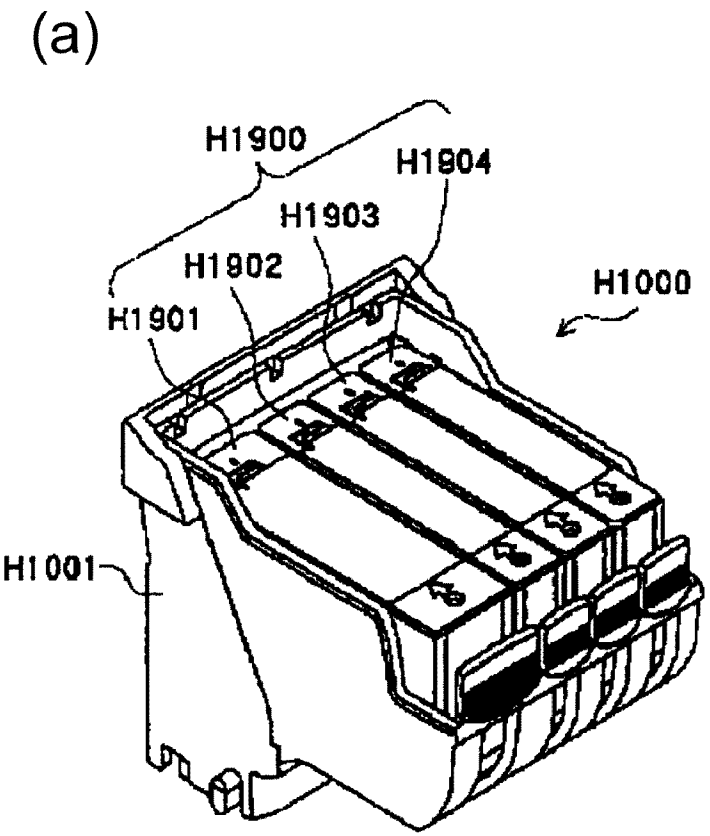

Referring to FIG. 1, in (a) and (b), which are perspective views of the recording head portion H1001 in accordance with the present invention, the recording head 1001 is one of the essential structural components of the recording head cartridge H1000 in the first embodiment. The recording head cartridge H1000 is made up of the recording head portion H1001 and ink containers H1900. The ink container H1900 is removably connectible to the recording head portion H1001. The recording head cartridge H1000 is mounted on the carriage (unshown) of the main assembly of the ink jet recording apparatus, being precisely positioned relative to the carriage by a recording head cartridge positioning means. It is removably mountable on the carriage. As the recording head cartridge H1000 is mounted on, or removed from, the carriage, electrical connection is established or broken, respectively, between the recording head cartridge H1000 and carriage (main assembly).

The recording head cartridge H1000 (recording apparatus) in this embodiment uses four ink containers H1900, namely, an ink container H1901 for black ink, an ink container H1902 for cyan ink, an ink container H1903 for magenta ink, and an ink container H1904 for yellow ink. These ink containers H1901, H1902, H1903, and H1904 are removably connectable to the recording head portion H1001, independently from each other; they are individually connectable to the recording head portion H1001. This structural arrangement makes it possible to replace each ink container H1900 as necessary, preventing thereby ink from being wasted. Thus, the employment of this structural arrangement makes it possible to reduce an ink jet recording apparatus in printing cost.

Next, the recording head portion H1001 will be described in more detail, regarding each of its structural components.

(1-1) Recording Head Portion

The recording head of the recording head portion H1001 in this embodiment is a BUBBLE-JET (registered commercial name) recording head, which uses electrothermal transducers for generating the thermal energy for causing ink to boil in the so-called film-boiling manner, in response to electrical signals. Each electrothermal transducer is positioned opposite an ink jetting opening. That is, the recording head is of the so-called side shooter type.

Figure 2:
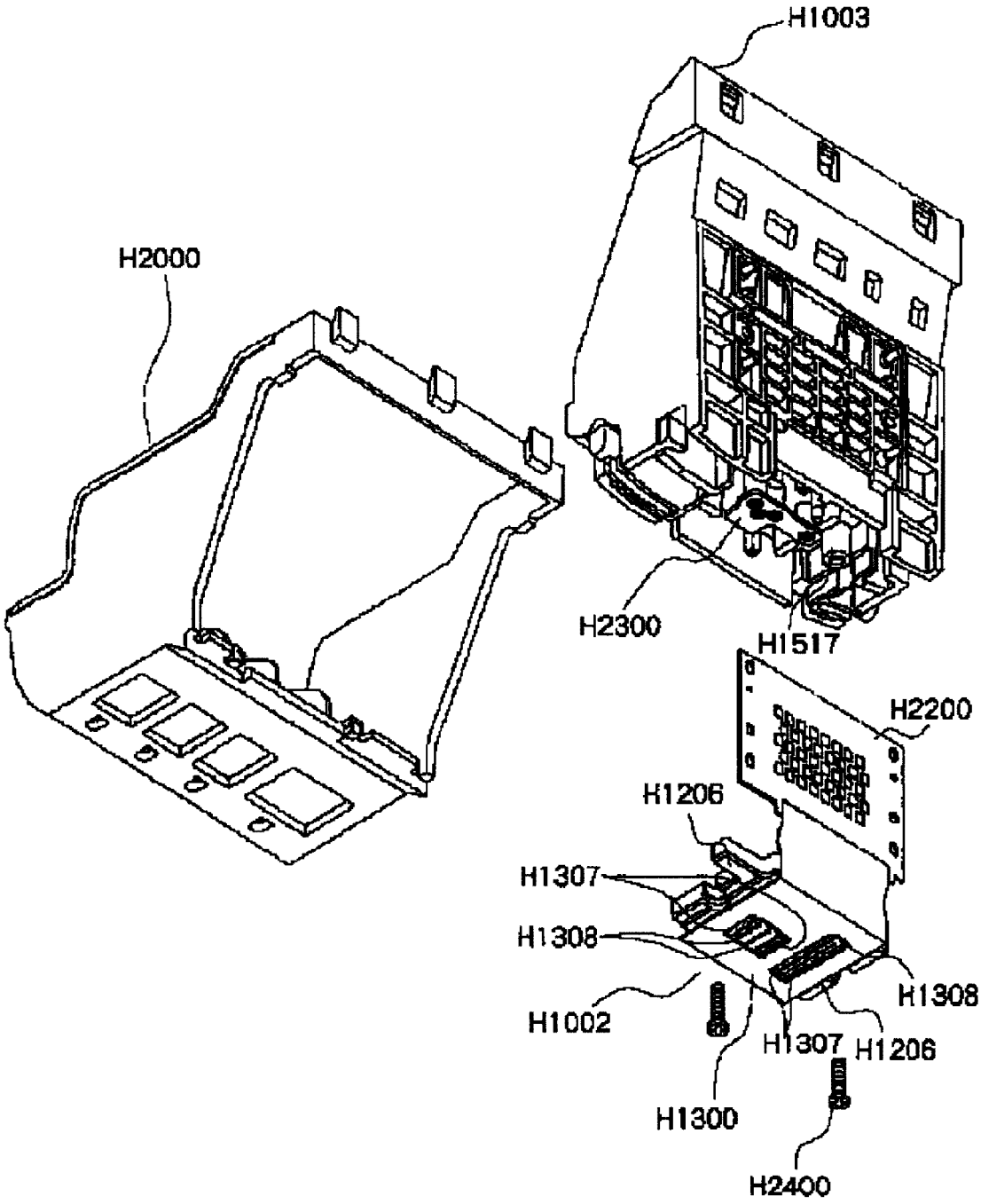
FIG. 2 is an exploded perspective view of the recording head portion of the recording head cartridge in the first embodiment of the present invention.

Referring to FIG. 2 which is an exploded perspective view of the recording head cartridge in the first embodiment of the present invention, the recording head portion H1001 is made up of a recording element unit H1002, an ink supplying unit H1003 (liquid supplying unit), and an ink container holder H2000.

Figure 3:
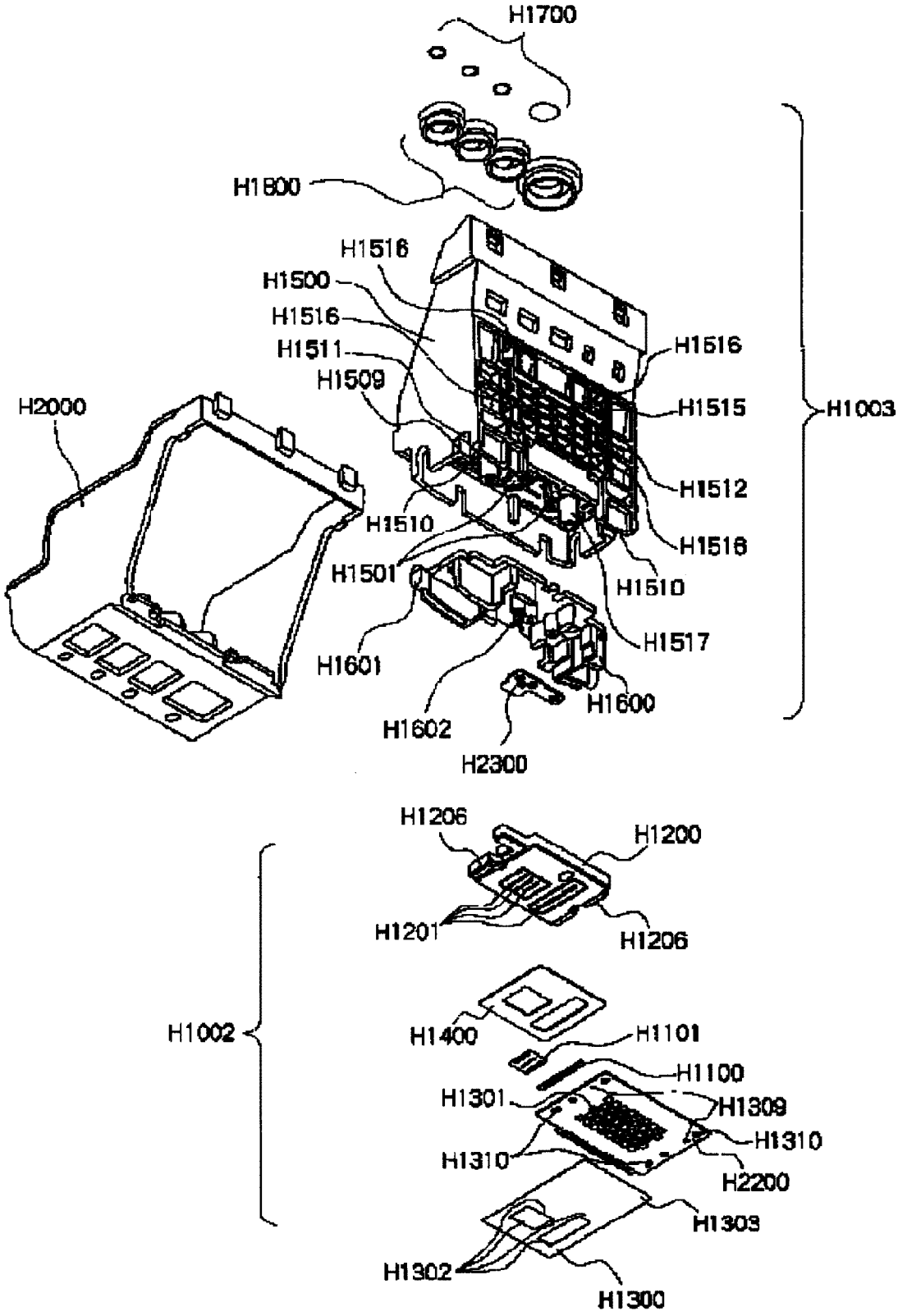
FIG. 3 is a detailed exploded perspective view of the recording head portion in the first embodiment of the present invention.

Next, referring to FIG. 3 which is an exploded perspective view of the recording head portion of the first embodiment of the present invention recording head, the recording unit H1002 is made up of a first recording chip H1100, a second recording chip H1101, a first plate H1200, an electric wiring tape H1300 (electric wiring chip), an electric contact chip H2200, and a second plate H1400. Further, an ink supply unit H1003 is made up of an ink supplying member H1500, a flow passage forming member H1600, a joint sealing member H2300, a filter H1700, and a rubber seal H1800.

(1-1-1) Recording Unit

The first plate H1200 is 0.5-10 mm in thickness, and is formed of alumina ($Al_2O_3$), for example. However, the material for the first plate H1200 does not need to be limited to alumina. That is, it may be a substance, other than alumina, which is equal or higher in thermal conductivity than the material for the recording chips H1100 and 1101. For example, it may be any among silicon (Si), aluminum nitride (AlN), zirconia ($ZrO_2$), silicon nitride ($SiN_4$), silicon carbide (SiC), molybdenum (Mo), and tungsten (W). The first plate H1200 has four ink supplying holes H1201, that is, an ink supplying hole H1201 for supplying the first recording chip H1100 with black ink, and three ink supplying holes H1201 for supplying the second recording chip H1101 with cyan, magenta, and yellow inks, correspondingly. Further, it has a pair of screw anchoring portions H1206, which are located at the edges perpendicular to the lengthwise direction of the ink supplying holes 1201, to keep the first plate H1200 reliably fastened to the recording unit H1002.

Figure 4:
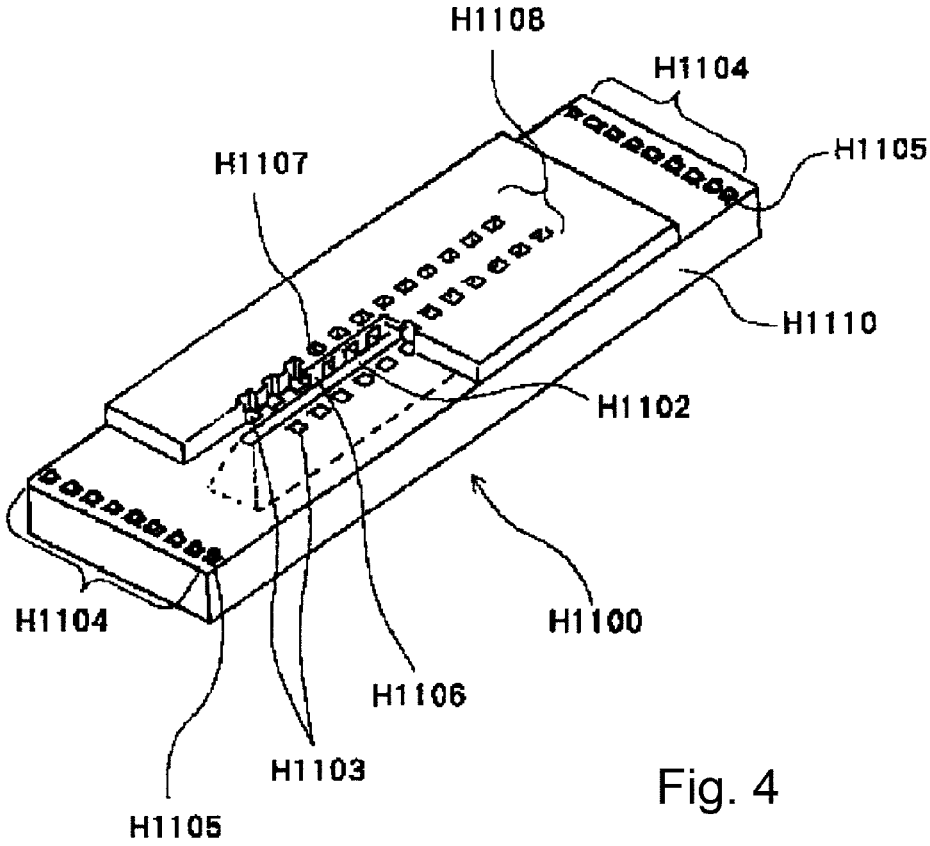
FIG. 4 is a partially broken perspective view of the first recording chip in the first embodiment of the present invention.

FIG. 4 is a partially broken perspective view of the first recording chip H1100 in the first embodiment of the present invention, and describes the structure of the recording element chip H1100. The first recording chip H1100 is made up of a substrate H1110, two columns of electrothermal transducers H1103, and unshown electric wiring. The substrate H1110 is 0.5- 1mm in thickness, and is formed of silicon. It has an ink supplying hole H1102, which is long and narrow at the top and bottom openings. The two columns of electrothermal transducers H1103 are positioned on each side of the ink supply hole H1102, one for one. The electric wiring is for supplying the electrothermal transducers with electric power, and is formed of aluminum or the like. The electrothermal transducers H1103 and electric wiring are formed by film forming technologies. Further, the electrothermal transducers H1103 are arranged in a pattern (zig-zag pattern) of foot prints formed on wet sand by a plover. That is, in terms of the direction parallel to the ink supply hole 1102, the two columns of electrothermal transducers H1103 are displaced relative to each other so that a given electrothermal transducer in one column does not align with an electrothermal transducer in the other column in terms of the direction perpendicular to the two columns of electrothermal transducers H1103. Further, the first recording chip H1100 is provided with a pair of electrode portions H1104 for providing the electric wiring with electric power. The two electrode portions H1104 are placed along the two edges, one for one, of the substrate H1110, which are perpendicular to the ink supply holes H1102. Each electrode portion H1104 has a row of bumps H1105 formed of gold (Au) or the like. The surface of the silicon substrate H1110, on which the abovementioned components are located, is covered with a structural components formed of a resinous substance with the use of photolithographic technologies. This structural component has wall portions H1106 which make up the lateral walls of the ink passages which correspond one for one with the electrothermal transducers H1103, and the top wall portion which makes up the top wall of each ink passage. The top wall portion has the opening of each of the ink jetting holes H1107 (which hereafter may be referred to simply as nozzles). The nozzles H1107 and electrothermal transducers H1103 are positioned so that they oppose each other one for one. The nozzles H1107 are arranged in such a manner that their openings form two columns H1108. The ink supplied to each nozzle H1107 of the first recording chip H1100 is jetted out of the nozzle H1107 (which opposes one of the electrothermal transducers), by the pressure generated by a bubble generated by the heat from the corresponding electrothermal transducer.

Figure 5:
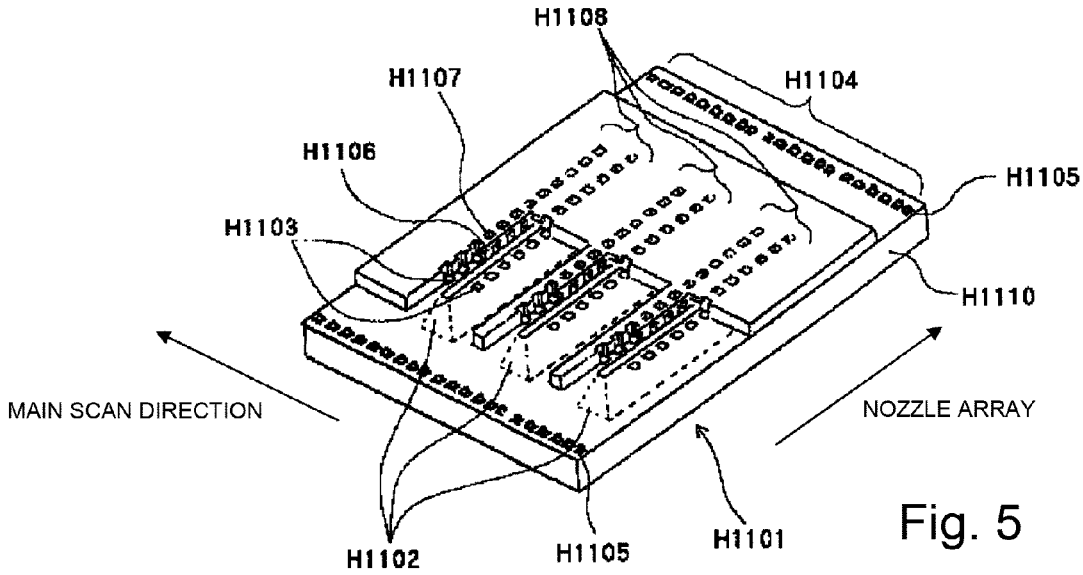
FIG. 5 is a partially broken perspective view of the second recording chip in the first embodiment of the present invention.

FIG. 5 is a partially broken perspective view of the second recording chip in the first embodiment of the present invention, which is for describing the structure of the chip. The second recording chip H1101 is for jetting out three color inks, namely, cyan, magenta, and yellow inks. It has three ink supplying holes H1102, which are arranged in parallel. It also has three pairs of columns of electrothermal transducers H1103 and three pairs of columns of nozzles H1107. One of each pair of columns of electrothermal transducers H1103 is slightly displaced relative to the other, in the direction parallel to the columns, so that as seen from the direction parallel to the columns, the electrothermal transducers H1103 are arranged in a pattern (zig-zag pattern) of the foot prints left on wet sand by a plover, and so are the ink jetting holes H1107. Like the first recording chip H1100, the second recording chip H1101 is made up of a substrate H1110 formed of silicon, and the electric wiring, electrode portions H1104, etc., formed on the substrate H1110. Further, the second recording chip H1101 has ink passage walls H1106 and ink jetting nozzles H1107, which are formed of a resinous substance with the use of photolithographic technologies. The electrode portions H1104 for supplying the electric wiring with electric power are provided with bumps H1105 formed of gold (Au) or the like, as are the electrode portions H1104 of the first recording chip H1100.

The recording chips H1100 and H1101 are precisely adhered to the first plate H1200 with the use of a first adhesive, in such a manner that their ink supplying holes 1102 precisely connect with the ink supplying holes of the first plate H1200, one for one. The first adhesive is desired to be low in viscosity, low in the temperature at which it hardens, short in the hardening time, relatively hard after its hardening, and resistant to ink. For example, a thermally curable adhesive, the main ingredient of which is epoxy resin, is desirable as the first adhesive. It is also desired that the thickness of the first adhesive layer is no more than 50 μm after its hardening.

The second plate H1400 is 0.5-10 mm in thickness, and is formed of a ceramic such as alumina ($Al_2O_3$), or a metallic substance, such as aluminum, stainless steel, etc., for example. It has two holes, which are larger than the first and second recording chips H1100 and H1101 fixed to the first plate H1200 with the use of the adhesive. The second plate 1400 is fixed to the first plate H1200 with the use of a second adhesive, in such a manner that as the electric wiring tape H1300 is adhered to the first and second recording chips H1100 and H1101, the electric wiring tape H1300 remains flat.

The electric wiring tape H1300 is the electric signal passage, through which the electric signals for causing the first and second recording chips H1100 and H1101 to jet ink are applied to the first and second recording chips H1100 and H1101. The electric wiring tape H1300 has two holes, which correspond in position to the recording chips H1100 and H1101, one for one. It also has two sets of electrical terminals H1302, which are to be connected to the electrode portions H1104 of the recording chips H1100 and H1101, respectively. Further, the electric wiring tape H1300 has electrical terminal connecting portions H1303, which are located at one of its edge portions to make electrical connections between the electric wiring tape H1300 and an electrical contact chip H2200 having external signal input terminals H1301 for receiving electrical signals. The electrical terminals H1302 and electrical terminal connecting portion H1303 are in connection with each other through a continuous patterned wiring formed of copper foil. The electric wiring tape H1300 is fixed to the second plate H1400 with a third adhesive placed between the back surface of the electric wiring tape H1300 and the bottom surface of the second plate H1400. Further, the electric wiring tape H1300 is bent in the thickness direction of the first plate H1200, and is fixed to one of the lateral surfaces of the first plate H1200. As the third adhesive, a thermally curable adhesive, the main ingredient of which is epoxy resin, is used, for example, and is applied by such an amount so that the layer of the third adhesive will be 10-100 μm in thickness after its hardening.

The electrical connection between the electric wiring tape H1300 and first recording chip H1100, and the electrical connection between the electric wiring tape H1300 and second recording chip H1101, are established by connecting the electrode portions H1104 of the first and second recording chips H1100 and H1101 to the electrical terminals H1302 of the electric wiring tape H1300 with the use of ultrasonic waves. The electrical joints between the first recording chips H1100 and electric wiring tape H1300, and the electrical joints between the second recording chip H1101 and electric wiring tape H1300, are sealed with a body of a first sealant H1307 and a body of second sealant H1308, respectively, in order to prevent the joints from being corroded by ink, and also, to protect the joints from external impacts. The first sealant H1307 is primarily used to seal the joints between the electrical terminals H1302 of the electric wiring tape H1300 and the electrode portions H1104 of the recording chips H1100 and H1101, from the back side, and also, to seal the peripheries of the recording chips H1100 and H1101. On the other hand, the second sealant H1308 is used to seal the joints from the front side. The electric wiring tape H1300 is in connection with the electrical contact chip H2200, which is attached to one of the edge portions of the electric wiring tape H1300 with the use of a piece of electrically conductive isotropic film or the like, by applying heat and pressure. The electrical contact chip H2200 has a terminal positioning hole H1309 and a terminal connection hole H1310 for its fixation.

(1-1-2) Ink Supply Unit

Referring to FIG. 3, an ink supplying member H1500 is one of the structural members of an ink supply unit H1003, which is for guiding ink from an ink container H1900 to the recording unit H1002. It is formed of a resin, for example, by molding. It is desired that glass filler is mixed into the resinous material for the ink supplying member H1500, by a ratio of 5-40%, in order to make the ink supplying member H1500 rigid in shape.

Figure 6:
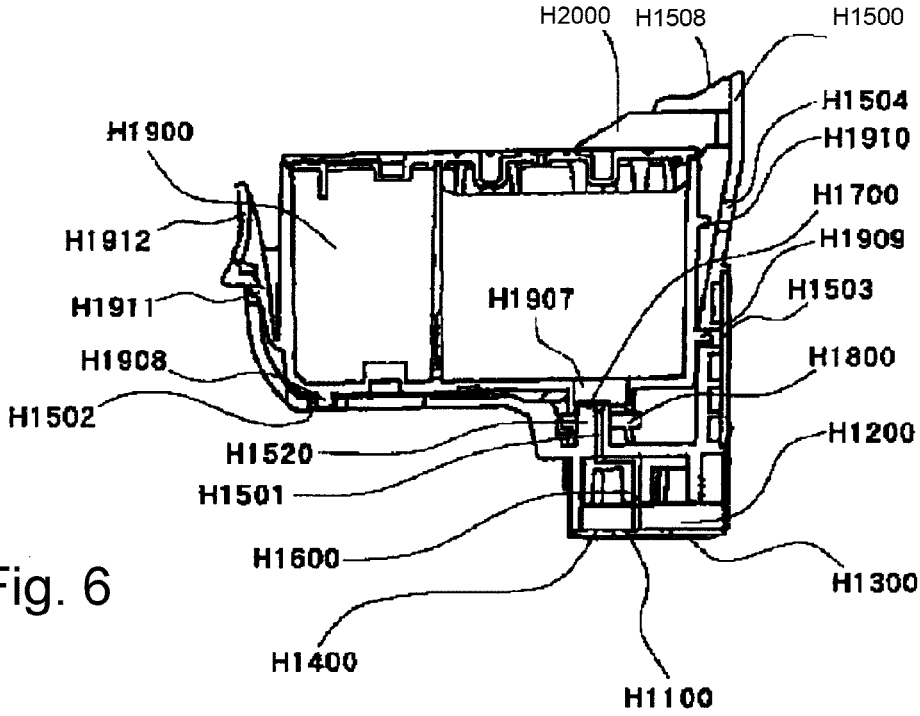
FIG. 6 is a sectional view of the recording head cartridge in the first embodiment of the present invention, at a plane perpendicular to the moving direction of the recording head cartridge.

Next, referring to FIG. 6, the ink supplying member H1500 and an ink container holder H2000 make up the ink container storage portion in which the ink containers H1900 are removably mountable. The bottom portion of this ink container storage portion is provided with ink container positioning holes H1502, in which the ink container positioning pin H1908 of each of the ink containers H1900 fits. The rear wall of the ink container storage portion has: a first hole H1503 in which the first claw of each ink container H1900 fits; and a second hole H1504 in which the second claw H1910 of each ink container H1900 fits. On the other hand, the front portion of each of the ink containers H1900 is provided with an elastic lever H1912 having a third claw H1911, which engages with the wall of the ink container storage portion. This lever H1912 is elastically deformable by the application of pressure to disengage the third claw H1911 from the wall of the ink container storage portion so that the ink container H1900 can be removed. Among the abovementioned structural features, the holes H1503 and H1504 are parts of the ink supplying member H1500. That is, the ink supplying member H1500 is a part of the means for removably holding the ink container H1900.

The bottom portion of the ink container storage portion of the ink supplying member H1500 is provided with a connective portion H1520, which is placed in contact with the ink outlet hole H1907 of the ink container H1900. The connective portion H1520 is fitted with a filter H1700 for preventing the entrance of foreign substances, such as dust in the air. The filter H1700 is welded to the connective portion H1520. Further, the connective portion H1520 is fitted with the rubber seal H1800 for preventing the ink evaporation from the joint between the ink supplying member H1500 and ink container H1900. The interior of the ink supplying member H1500 has an ink passage H1501, which extends from its connective portion H1520 (which is connected to ink container H1900) to its bottom surface. To the bottom surface of the ink supplying member H1500, an ink passage forming member H1600 is attached by ultrasonic welding. The ink passage forming member H1600 has ink inlet holes H1602 for supplying the recording unit H1002 with ink. The ink passage forming member H1600 is precisely positioned relative to the ink supplying member H1500 so that the ink inlet holes H1602 and the ink passages H1501 of the ink supplying member H1500 become perfectly connected one for one.

(1-1-3) Joining of Recording Unit and Ink Supply Unit

Next, the joining of the recording unit H1002 and ink supply unit H1003 will be described.

The recording unit H1002 and ink supply unit H1003 are joined with each other by small screws H2400, with the placement of a joint seal 2300 between the two units H1002 and H1003. The joint seal H2300 is provided with holes, which correspond in position to the ink supplying holes H1201 of the first plate H1200 and the ink inlet holes 1602 of the ink passage forming member H1600. The joint seal H2300 is formed of an elastic substance, such as rubber, which is very small in permanent compression deformation. With the interposition of the abovedescribed joint seal H2300 between the recording unit H1002 and ink supply unit H1003, it is ensured that ink does not leak from the joint between the two units H1002 and H1003. The electrical contact chip H2200 of the recording unit H1002 is fixed to the back surface of the ink supplying member H1500, being precisely positioned relative to the ink supplying member H1500; the electrical contact chip H2200 is precisely positioned relative to the ink supplying member H1500 by placing, in the terminal positioning holes 1309, the two terminal positioning pins H1515 on the back surface of the ink supply unit H1003. That is, as the electrical contact chip H2200 is precisely positioned relatively to the back surface of the ink supplying member H1500, and fixed thereto, the terminal connective pins H1516 of the ink supply unit H1003 are put through the terminal connective holes 1310. Then, the terminal connective pins H1516 are crimped to fix the electrical contact chip H2200 to the ink supply unit H1003. The fixing method does not need to be limited to the abovedescribed one; a method other than the abovedescribed one may be used.

Figure 7:
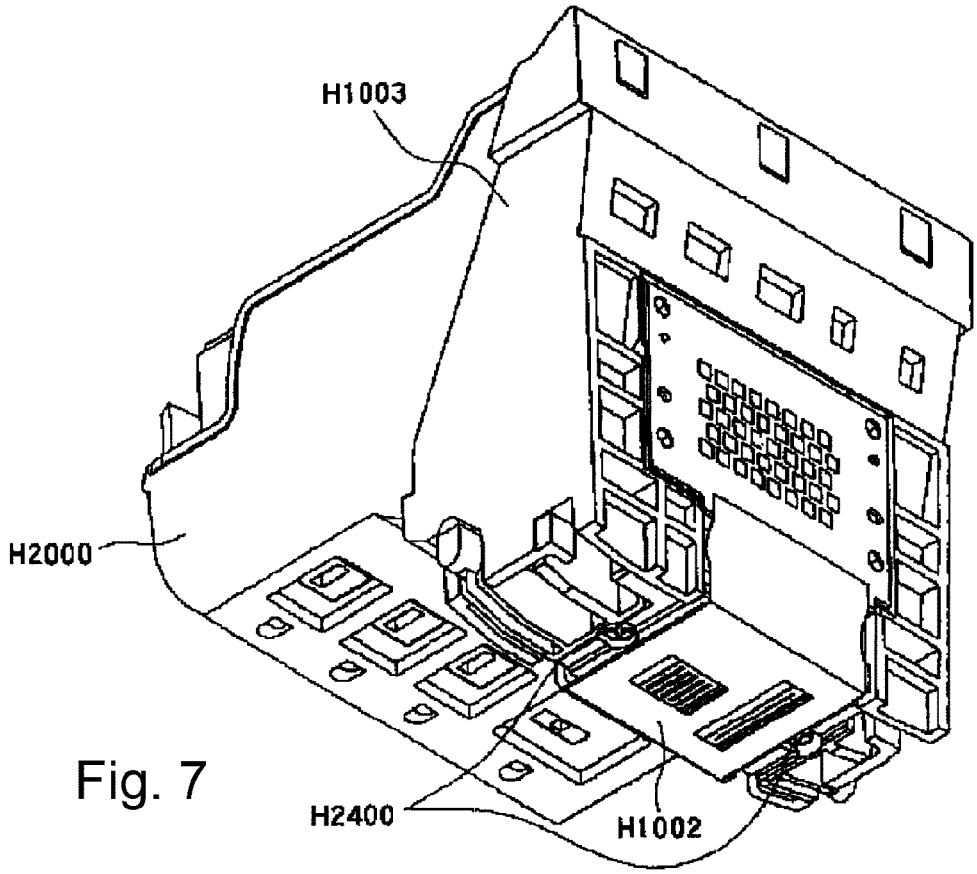
FIG. 7 is a perspective view of the assembled primary structural components of the first embodiment of the present invention.

The ink supply unit H1003 and recording unit H1002 are joined with each other as described above, and the connective portions of the ink container holder H2000 are fitted into the connective holes of the ink supplying member H1500, completing thereby the recording head portion H1001, which is shown in FIG. 7.

(2) Ink jet Recording Apparatus

The ink jet recording apparatus is such a recording apparatus that forms an image on a sheet of recording paper, by moving back and forth its recording head cartridge in a primary scan direction (carriage movement direction), for example, while controlling the movement of the sheet of recording paper by the control circuit of the apparatus.

Figure 8:
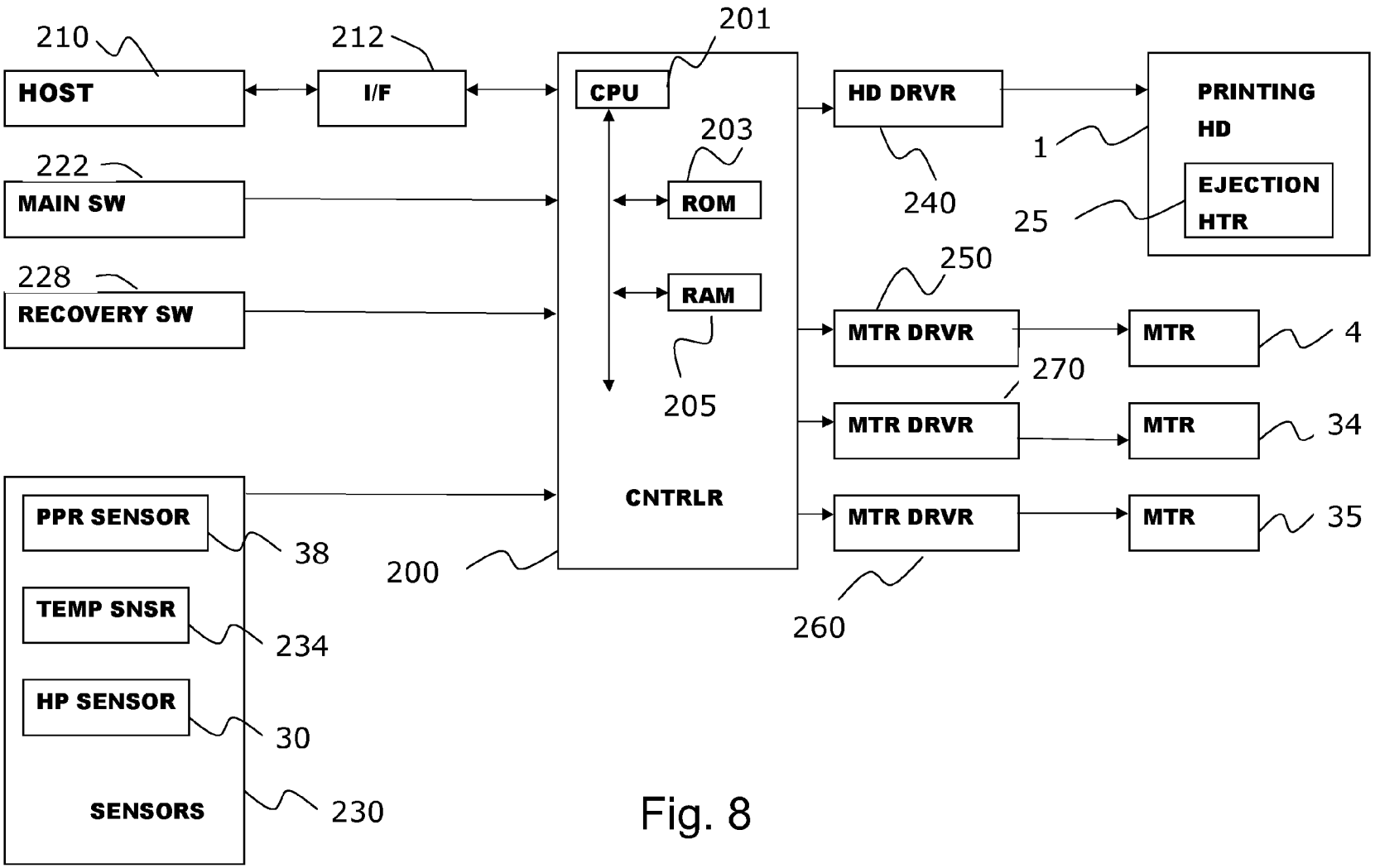
FIG. 8 is a block diagram of the control circuit of the ink jet recording apparatus in the first embodiment of the present invention.

FIG. 8 is a block diagram of the control circuit of the ink jet recording apparatus in this embodiment, and shows the general structure of the circuit. In the drawing, a controller 200 is the primary controller. It has a CPU 201 (Central Processing Unit), which is in the form of a microcomputer. The controller 200 also has: a ROM 203 (Read Only Memory) in which fixed data, such as programs and tables, are stored; and a RAM 205 (Random Access Memory) having the areas used for such an operation as the development of image formation data. A host apparatus 210 is an image data source (which may be a computer which forms and processes data for images to be printed, reader for reading original images, etc.). Image formation data, commands related to image formation, status signals, etc., are transmitted between the host apparatus 210 and ink jet recording apparatus through an interface 212 (I/F). An electric power switch 222, a recovery switch 226 (for initiating recording head suctioning operation to restore recording unit performance), etc., are parts of a group of switches, which are usable by an operator (user) to input operator's commands. A sensor group 230 is for detecting the state of the ink jet recording apparatus. It includes: a home position sensor 30 for detecting whether or not the recording head is in its home position; a paper end sensor 33 for detecting whether or not a printing medium (sheet of recording paper or the like) is present; and a temperature sensor 234 disposed in a position suitable for detecting the ambient temperature. A head driver 240 is a driver for driving ink jetting heaters 25 of the printing head 1 in accordance with print data, etc. It has: a shift register which aligns the print data with ink jetting heaters 25; and a latching circuit which latches print data with the ink jetting heaters 25 with proper timing. It also has: a logic circuit which activates ink jetting heaters 25 in synchronism with driving timing signals; and a timing setting portion which sets proper timing (ink jetting timing) for driving the electrothermal transducers to form each ink dot on a proper point on the recording medium. A motor driver 250 is a driver for driving a primary scan motor 4. A secondary scan motor 34 is the motor for conveying the recording sheet (in the secondary scan direction). The motor driver 270 is a driver for the secondary scan motor 34. A recording sheet feeding motor 35 is a motor for feeding one of recording sheets in an automatic sheet feeder, into the main assembly of the ink jet recording apparatus, or separating the recording sheet to be fed into the main assembly, from the rest. A motor driver 260 is for driving the recording sheet feeding motor 35.

Next, the formation of data for jetting ink onto a sheet of recording paper in order to maintain the ink jet recording apparatus in terms of ink jetting performance, that is, an operation which is not intended for image formation, will be described. The data for jetting ink to maintain the ink jet recording apparatus in performance is computed by the CPU 201, or stored in the ROM 203 in advance. The data are developed, along with print data, in the RAM 205. The developed maintenance data are transferred to the head driver, as are the print data, to activate the ink jetting heaters to jet ink.

The pattern, in which dots are to be formed on a sheet of recording medium when ink is jetted for the maintenance of the ink jet head in terms of performance, is computed by the CPU 201, or it is a preset pattern in one of the control programs. The preset pattern may be modified to satisfy one or more of various conditions. The unsatisfactory jetting of ink, which is attributable to the increase in the ink viscosity, is affected by the properties of the ink used for printing, in particular, moisture retaining ability, the ink type (dye-based ink or pigment-based ink, for example), and the temperature of the environment in which the ink jet recording apparatus is operated. Thus, the preset pattern may be modified in response to one or more of these factors. The ambient temperature is detected by the temperature sensor 234, with which the ink jet recording apparatus is provided. The recording data for jetting ink for the maintenance of the ink jet head, that is, the jetting of ink, which is not intended for image formation, need to be such that the dots which the ink droplets jetted for the maintenance form on a sheet of recording paper as they land on the recording sheet, will be as low as possible in visibility. Thus, the pattern in which dots are to be formed by the ink droplets jetted for the maintenance is desired to be such that each ink dot does not overlap with the immediately adjacent ink dot, and also, that ink dots do not align in sequence in the direction parallel to the columns of nozzles. That is, the data for jetting ink for maintenance is desired to be such that the ink dots formed from the ink droplets jetted for maintenance that land on the recording sheet will scatter as they land on the recording sheet in such a pattern that the dots do not overlap at all. The larger the dot intervals, the better. Further, it is desired that when ink is jetted for maintenance, it is jetted so that the dots which the ink will form do not show periodicity. Thus, when the recording head is driven for maintenance, it is not continuously driven at the maximum frequency in terms of the primary scan direction. Instead, it is driven in such a manner that dots are formed with intervals of several millimeters to slightly longer than 10 mm, in terms of the widthwise direction of the recording sheet, and also, so that ink will not be simultaneously jetted from adjacent two nozzles in terms of the direction parallel to the column of nozzles, while a single ink droplet is jetted per nozzle. The number of ink droplets jetted per moving range of the recording head during a maintenance operation is in a range of 3-15. It has no relation with the print data; the ink droplets are jetted in a fixed pattern.

Table 1 is a summary of the results of the evaluation, in terms of visibility, of the dots formed by each of the inks when the ink was jetted for maintenance, that is, when the ink was not jetted for image formation. The table shows the relationship among volumes (ink droplet size) of ink droplets jetted for maintenance, ink colors, and visibility of the dots formed by the ink droplets jetted for maintenance. The dot diameters shown next to the ink droplet sizes, one for one, are the sizes of the ink dots formed on a sheet of coated paper for ink jet recording, and are given for reference.

TABLE 1

| | Ink droplet | | | |
|---|---|---|---|---|
| | 5.0 pl | 3.0 pl | 1.5 pl | 1.0 pl |
| | Dot dia. (μm) | | | |
| | 47 | 35 | 27 | 22 |
| Cyan | N | F | G | G |
| Magenta | N | F | G | G |
| Dye Blk | N | F | G | G |
| Yellow | F | G | G | G |
| L. Cyan | F | G | G | G |
| L. Mag. | F | G | G | G |

Table 1 shows the evaluation, in terms of visibility, of the dots formed when the various inks were jetted for maintenance at a ratio of roughly 3-6 ink droplets per raster. Here, visibility means how inconspicuous were the dots formed by the ink droplets jetted for maintenance, that is, the ink droplets which were not intended for image formation. More specifically, the inconspicuousness of the dots was evaluated by subjects whose eyesight is in a range of roughly 1.0-1.5, from a distance of roughly 20 cm. "G" indicates that the dots on the recording sheet are satisfactorily low in visibility (inconspicuous), and "F" indicates that they are middle in visibility. "N" means that the dots are unsatisfactorily high in visibility (conspicuous). The recording papers used for the evaluation of the dots in terms of visibility are paper made of ordinary wood pulp. The tests provided results which are easily predictable. That is, the smaller the ink droplet size, and the higher the ink in brightness, the lower in visibility (more inconspicuous) were the dots formed on the recording paper by the ink droplets jetted for maintenance. At the same time, the tests brought a new discovery (knowledge) that the visibility of a dot is affected by the color of ink. Based on this discovery (new knowledge), it is desired that in the case of yellow ink (which is a naturally light color), light cyan ink, and light magenta ink, the ink droplet size is no more than roughly 4 pl, whereas in the case of cyan ink and magenta ink (which are naturally darker inks) and dye-based black ink, the ink droplet size is no more than roughly 2 pl. However, ink droplet size may be selected according to the performance of the ink, the rate at which each ink bleeds on the recording paper, and the like factors. The ink droplet size for a recording head, and the structure and arrangement of the ink jetting nozzles (columns of nozzles) for a recording head for each color, are determined according to the visibility of the dots formed by the ink droplets jetted for maintenance.

In this embodiment, three inks different in color are used, and the inks are jetted out in two different sizes. That is, an ink of lighter color is jetted in a relatively large size, and two inks of darker color are jetted in a relatively smaller size. More specifically, the ink droplet size for the ink of light color is no more than roughly 4 pl, and the ink droplet size for the inks of darker color is no more than roughly 2 pl. In addition, the number of nozzles per column of nozzles for the ink of lighter color is greater than that for the ink of darker color. The tests were carried out to evaluate in visibility the dots formed by the ink droplets jetted for maintenance by the ink jet head structured as described above to confirm the validity of this structural arrangement.

Figure 9:
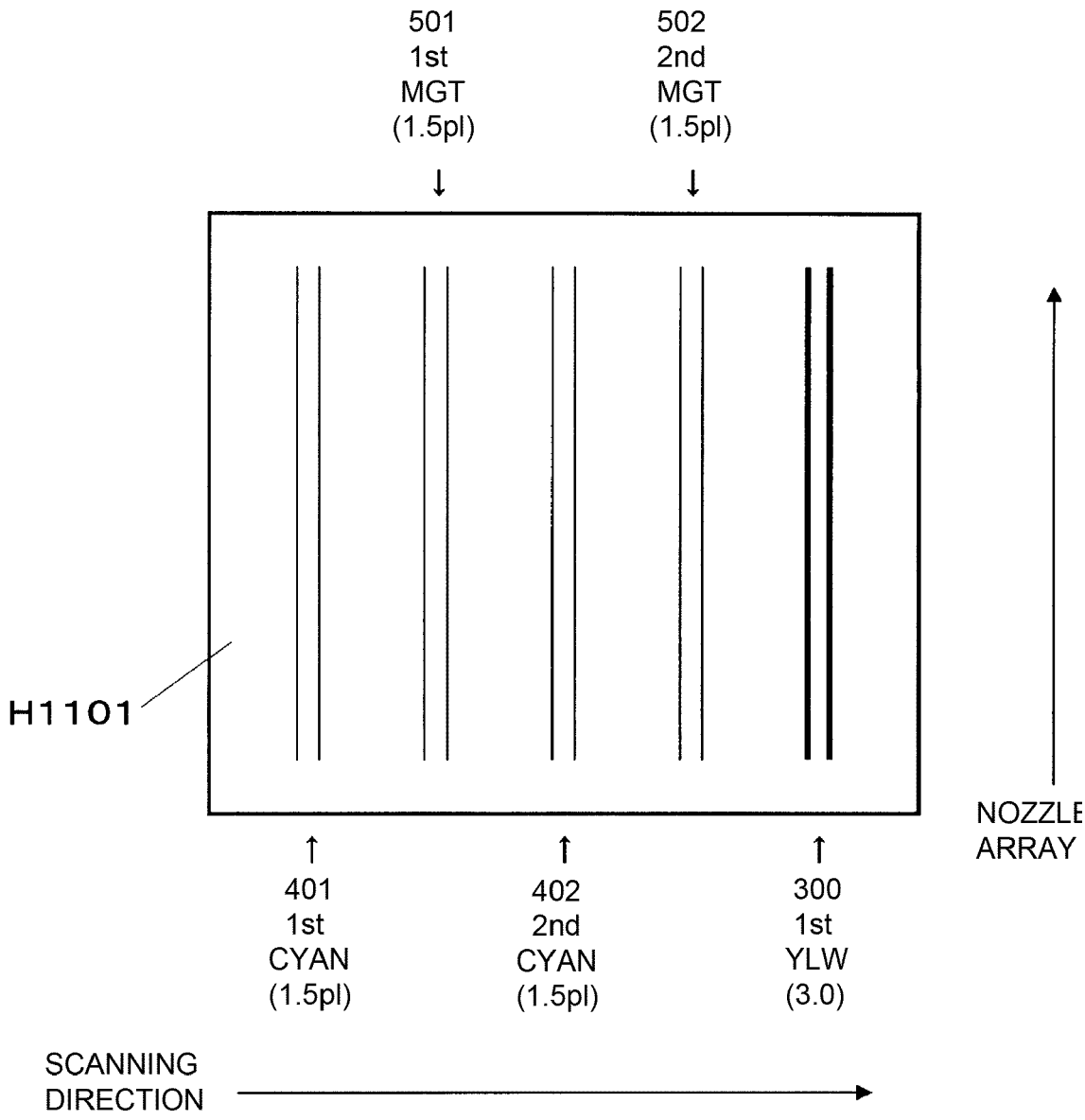
FIG. 9 is a plan view of the recording chip of the first embodiment of the present invention, as seen from the side where the nozzle openings are located.

FIG. 9 is a schematic plan view of the second recording chip H1101 of the recording head of the first embodiment of the present invention, as seen from the side where the ink jetting openings of the nozzles are located. It shows the ink droplet size and nozzle column arrangement for each ink. The three inks to be jetted for maintenance are cyan, magenta, and yellow inks. The second recording chip H1101 is provided with five pairs of columns of nozzles, and also, three ink containers H1900 for three color inks, one for one. Obviously, there is no problem even if the ink containers are not independent from each other.

The first preferred embodiment of the present invention is characterized in that two columns of nozzles (columns of small nozzles), which are roughly 1.5 pl in ink droplet size, are assigned to each of the cyan and magenta inks. More specifically, the opening of each small nozzle has a proper size for jetting ink droplets which are roughly 1.5 pl in volume. The ink jet head in this embodiment has 512 nozzles per column of nozzles. However, it is not problematic even if the number of nozzles per column of nozzle is different from that in this embodiment. Further, the order in which the columns of nozzles for each ink are arranged in terms of the primary scan direction of the recording head is: pair of columns of nozzles 401 for first cyan ink, pair of columns of nozzles 501 for first magenta ink, pair of columns of nozzles 402 for second cyan ink, and pair of columns of nozzles 502 for the second magenta ink, listing from the upstream side in terms of the primary scanning direction. Further, a pair of columns of nozzles 300 (columns of large nozzles) for the first yellow ink, which are roughly 3.0 pl in ink droplet volume are on the downstream side of the second magenta ink columns 502. The opening of each large nozzle has a proper size for jetting ink droplets which are roughly 3.0 pl in volume. The nozzle count of each column of large nozzles, namely, the column 300 of nozzles for yellow ink is 512, whereas the nozzle count of each column of small nozzles, namely, each of the cyan columns of nozzles 401 and 402 for cyan ink, and each of the columns 501 and 502 of nozzles for magenta ink, is 1,024. That is, this embodiment is also characterized in that the nozzle count of the column of small nozzles is twice that of the column of large nozzles.

Figure 10:
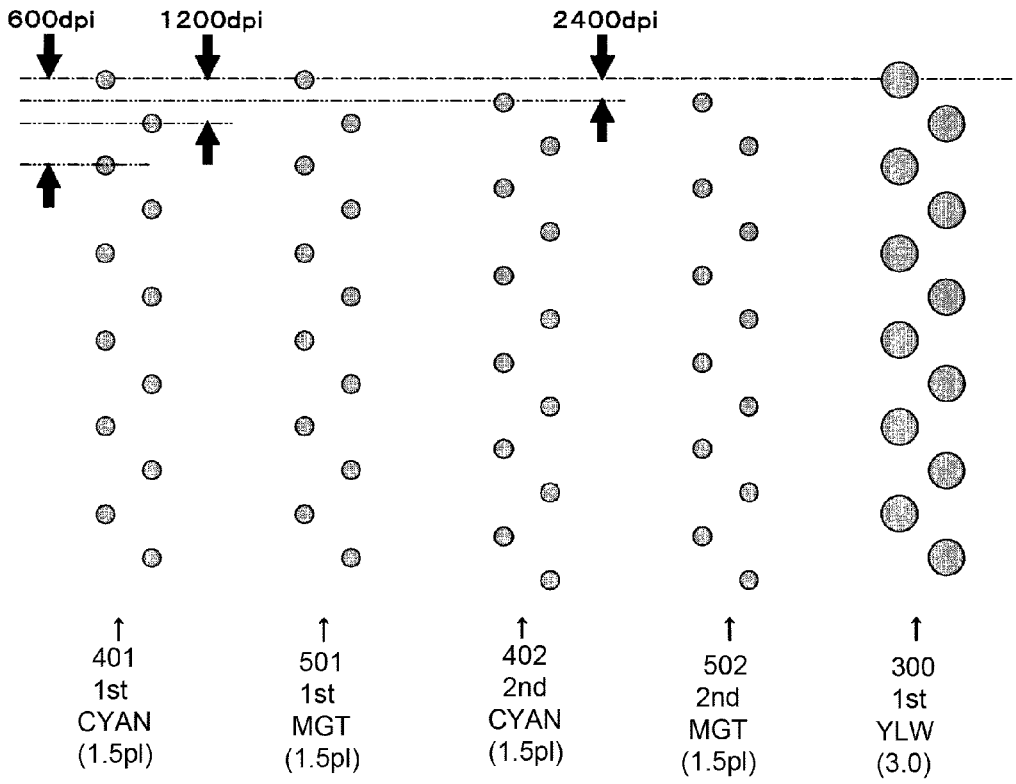
FIG. 10 is a detailed view of the surface of the recording chip, at which the nozzle openings are located, in the first embodiment of the present invention, showing in detail the arrangement of the columns of nozzles.

Further, the pitch of each of the pair of columns of large nozzles is 600 dpi. That is, the nozzles of each column of large nozzles are positioned with intervals (pitch) of roughly 0.0423mm (25.4 mm/60). Further, the two columns are displaced relative to each other in the direction parallel to the columns by a distance equal to one half the interval (pitch), so that, as seen from the direction parallel to the columns, the nozzles are disposed in a zig-zag pattern. Thus, the combined pitch of the pair of columns of large nozzles is 1,200 dpi. However, the nozzle count and pitch for the column of large nozzles do not need to be limited to those mentioned above. Further, the pitch of each of the pair of columns of small nozzles, that is, the pair of columns of nozzles for each of the cyan and magenta inks, which is smaller in ink droplet size, is roughly 2,400 dpi, in other words, roughly 0.011 mm in nozzle opening interval. That is, this embodiment is also characterized in that the combined pitch of the pair of columns of small nozzles for each of the inks of light color is 2,400 dpi. Shown in FIG. 10 are the details of the abovementioned nozzle arrangement.

The recording head cartridges structured as described above were evaluated in terms of the visibility of the dots formed by the ink droplets jetted for maintenance. The method used for the evaluation is the same as that described previously. That is, ink droplets were jetted for maintenance at a rate of roughly 3-6 droplets per raster, on a sheet of recording paper, and the dots formed by the ink droplets were evaluated in terms of their visibility. The sheets of recording paper used for the evaluation were sheets of recording paper formed of ordinary pulp. The results were as follows: the dots formed on the sheet of recording paper by cyan, magenta, and yellow inks were all satisfactorily low in visibility, that is, m in the evaluation standard described previously. Moreover, the test images printed immediately after the completion of the operation in which ink was jetted for maintenance were satisfactory. That is, there was no sign that ink was erroneously jetted.

Images which appear significantly less grainy than the images formed with the use of a conventional ink jet recording head while maintaining it with the use of a conventional recording head maintaining method can be formed by structuring an ink jet head so that cyan and magenta inks can be jetted in a droplet size which is small enough for the dots formed by the droplets jetted for maintenance are satisfactorily low in visibility (inconspicuous). More concretely, it is possible to form graphic images, which do not appear as grainy, across their gray halftone areas, and/or color halftone areas, as the images formed by a conventional ink jet recording apparatus while a maintenance operation is carried out, and also, photographic images which do not appear as grainy, across the shadowy areas, and highlighted areas, such as blue sky areas and human skin areas, as the image formed by a conventional ink jet recording apparatus while a maintenance operation is carried out.

Further, structuring an ink jet head so that the number of the columns of nozzles for the ink which is to be jetted out in a smaller size compared to the dot interval is twice or more of that of the columns of nozzles for the ink which is to be jetted out in a larger size compared to the dot interval, makes it possible to print a higher speed than a conventional ink jet head, because an ink jet head structured as described above is greater in the number of image formation dots which can be deposited on a sheet of recording paper per scanning movement of the recording head cartridge. At this time, the expression of "greater in the number of image formation dots which can be deposited" will be explained with reference to FIG. 11.

Figure 11:
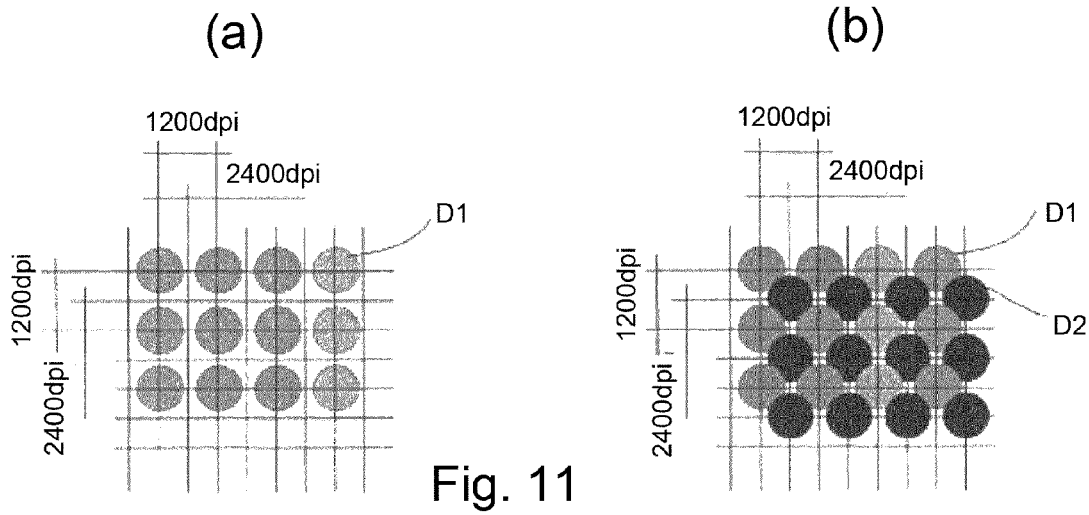
FIG. 11 is a schematic drawing of the matrix for the dot formation on recording medium, in the first embodiment of the present invention.

In FIG. 11, (*a*) and (*b*) are schematic drawings of the matrix in which dots are formed by the recording head in this embodiment per scan. More specifically, in FIG. 11, (*a*) shows the pattern in which ink dots are formed on the recording paper by a recording head which has only a single column of nozzles per ink (cyan ink, for example) when the resolution is 1,200 dpi and ink droplet size is 1.5 pl. In this case, the dot diameter is smaller than the dot interval of the recording head. Thus, the spaces among the dots are conspicuous. In comparison, in FIG. 11, (*b*) shows the pattern in which ink dots are formed on the recording paper by a recording head in this embodiment, which has two columns of nozzles per ink (for example, cyan ink). In this case, a group of dots D1 and a group of dots D2 are formed, in the same area corresponding to each raster, by the ink droplets jetted from the column 401 of nozzles for the first cyan ink, and the ink droplets jetted from the column 402 of nozzles for the second cyan ink, respectively. Therefore, the spaces among the dots on the recording paper are significantly smaller than those shown in drawing (a) of FIG. 11; the dots are formed with the presence of significantly smaller spaces among them. Thus, a single scan by this recording head can achieve a satisfactory high level of density.

Further, keeping the droplet size of such an ink as yellow ink relatively large, for example, 3.0 μl, yields the following effects: First, it reduces the amount of energy necessary for jetting the ink, and therefore, enables the recording head to retain heat more efficiently, contributing to the increase in print throughput. In addition, when the ink is jetted for maintenance, onto the recording paper, that is, even when ink jetting is not intended for image formation, the dots formed on the recording paper are satisfactorily low in visibility. Therefore, the operation for maintaining the recording head can be increased in speed. Thus, the print throughput drastically increases.

In this embodiment, the resolution of the dots formed by smaller ink droplets is twice that of the dots formed by larger ink droplets. However, there is no problem even if the resolutions different from those in this embodiment are used. Further, regarding the nozzle column count, the number of the columns of nozzles which jet smaller ink droplets may be three or four times the number of the columns of nozzles which jet larger ink droplets. In such a case, the size of a smaller ink droplet may be ⅓ or ¼ of the size of a larger ink droplet. Further, a recording head may be structured so that, instead of providing a recording head with twice or more number of columns of nozzles for jetting smaller ink droplets than the number of column of nozzles for jetting larger ink droplets, the nozzle count of each column of nozzles for jetting smaller ink droplets is greater than the nozzle count of a column of nozzles for jetting large ink droplets.

Further, there is no requirement regarding the order in which columns of nozzles, which are different in the color of the ink they jet, are arranged.

Embodiment 2

The recording head in this embodiment is superior to the recording head in the first embodiment, in terms of image quality, and also, is higher in print throughput than the recording head in the first embodiment.

Figure 12:
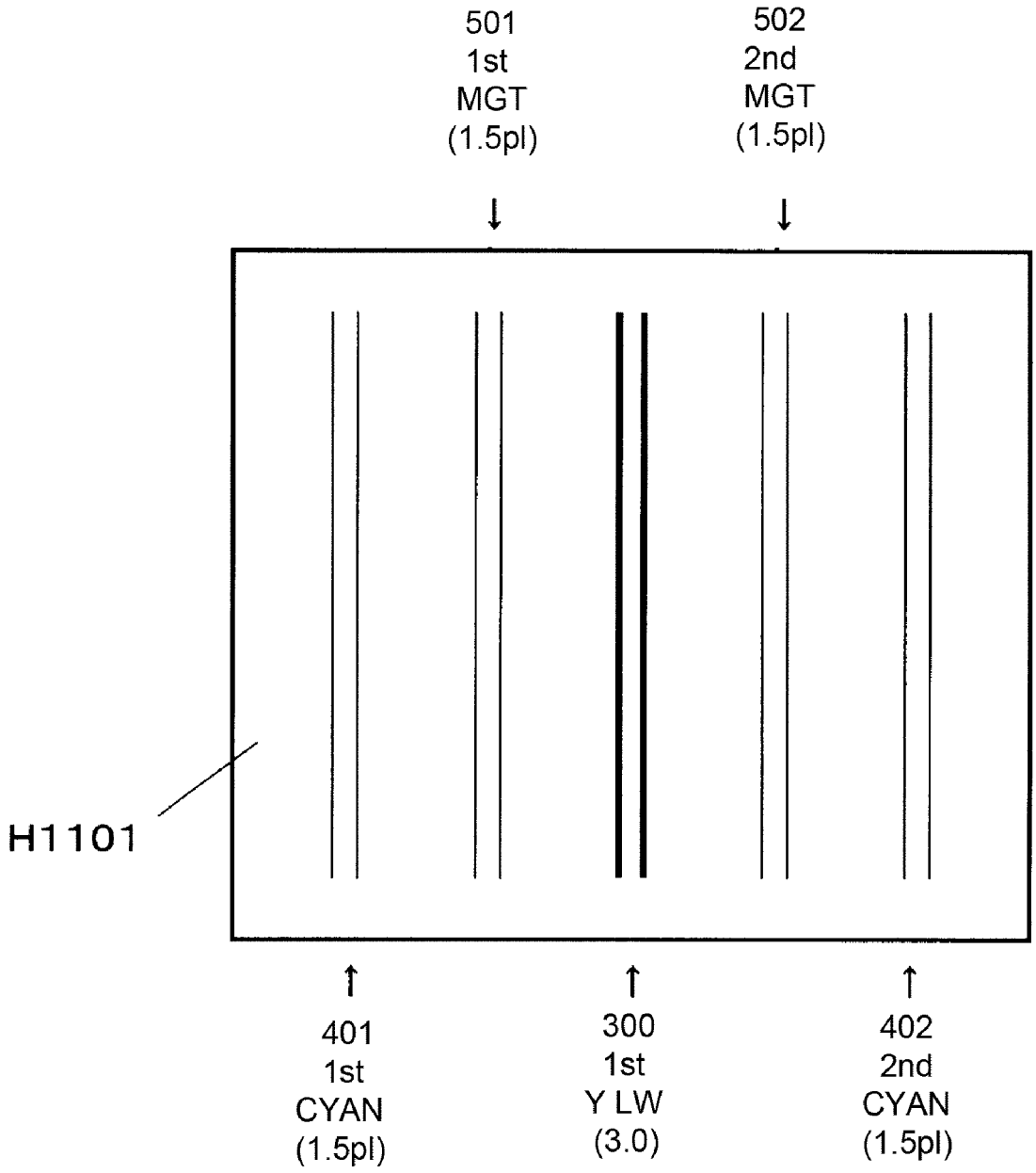
FIG. 12 is a plan view of the surface of the recording chip of the recording head in the second embodiment of the present invention, as seen from the side where nozzle openings are located.

FIG. 12 is a plan view of the surface of the second recording chip H1101 of the recording head cartridge in the second embodiment of the present invention, as seen from the side where nozzle openings are located, and shows the ink droplet sizes and the arrangement of the columns of nozzles different in the color of the ink they jet. This embodiment is the same as the first embodiment, except for the arrangement of the columns of nozzles. Thus, only the arrangement of the columns of nozzles in this embodiment will be described.

The second embodiment of the present invention can be characterized as follows: The recording head in this embodiment is also provided with two columns of small nozzles for each of the cyan and magenta inks, as is the recording head in the first embodiment, but is different in the arrangement of the columns of nozzles from that in the first embodiment. Referring to FIG. 12, listing from the lefthand side, a pair of columns of nozzles 401 for the first cyan ink, a pair of columns of nozzles 501 for the first magenta ink, a pair of columns of nozzles 300 for the first yellow ink, a pair of columns of nozzles 502 for the second magenta ink, and a pair of columns of nozzles 402 for the second cyan ink, are positioned as listed. That is, the pair of columns of large nozzles are placed in the middle, and two sets of two pairs of columns of small nozzeles are symmetrically placed on the left- and right-hand sides of the pair of columns of large nozzles. As long as the number of the pairs of columns of small nozzles is even, the columns of small nozzles can be arranged so that the set of the columns of nozzles on the left-hand side relative to the central pair of columns of nozzles (large nozzles), and the set of columns of nozzles on the right-hand side, are symmetrically positioned with respect to the central pair of columns of nozzles, in terms of nozzle size and ink color. The ink nozzle count per column of small nozzles, ink nozzle count per column of large nozzles, nozzle column count, nozzle opening pitch of each column of small nozzles, nozzle opening pitch of each column of large nozzles, etc., are the same as those of the recording head in the first embodiment.

The results of the tests carried out to evaluate the visibility of the dots formed by the ink droplets jetted for maintenance by the recording head cartridge in this embodiment are as follows. The evaluation method is the same as that used for evaluating the recording head cartridge in the first embodiment. The cyan ink dots, magenta ink dots, and yellow ink dots on the recording paper were all satisfactorily low in visibility, being "G" with reference to the same evaluation standard as that used for evaluating the recording head cartridge in the first embodiment. Further, the test images printed immediately after the completion of the operation in which inks were jetted for maintenance were satisfactory, showing no signs of erroneous jetting of ink.

Not only does this embodiment have the same effects as those which the first embodiment has, but also, it can prevent the problem that an image printed at a high speed while scanning only once each area of a sheet of recording paper, which is equivalent to a single raster, appears nonuniform because of the difference between the areas of the image, which were formed when a recording head is moved in one direction, and the areas of the image, which were formed when the recording head is moved in the other direction (bidirectional printing).

More concretely, when forming an image made of multiple areas different in color (for example, red, blue, green, and also, gray effected by depositing the inks of preceding three colors), the order in which color inks are deposited on the recording paper when the recording head is moved in one direction is the same as that in which the color inks are deposited on the recording paper when the recording head is moved in the other direction. Therefore, the problem that the areas of an image, which were formed by depositing inks on the recording sheet while the recording head was moved in one direction, appear different in tone from the areas of the image, which were formed by depositing inks on the recording sheet while the recording head was moved in the other direction, does not occur.

Figure 13:
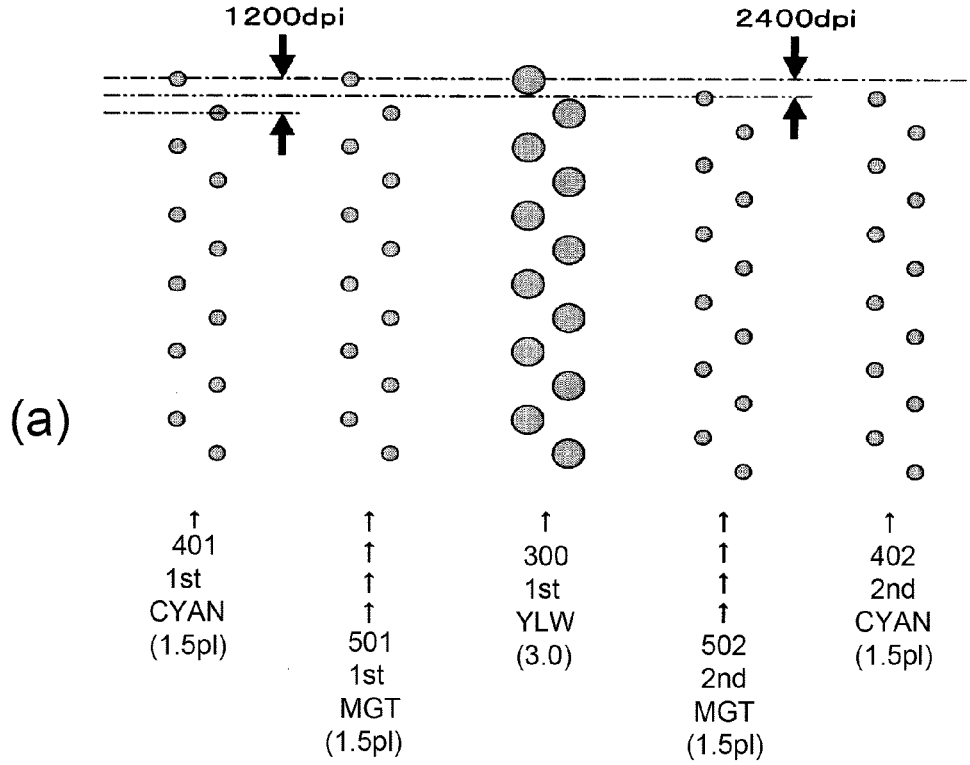
FIG. 13 is a detailed view of the surface of the recording chip, at which the nozzle openings are located, in the second embodiment of the present invention, showing in detail the arrangement of the columns of nozzles.
Figure 13:
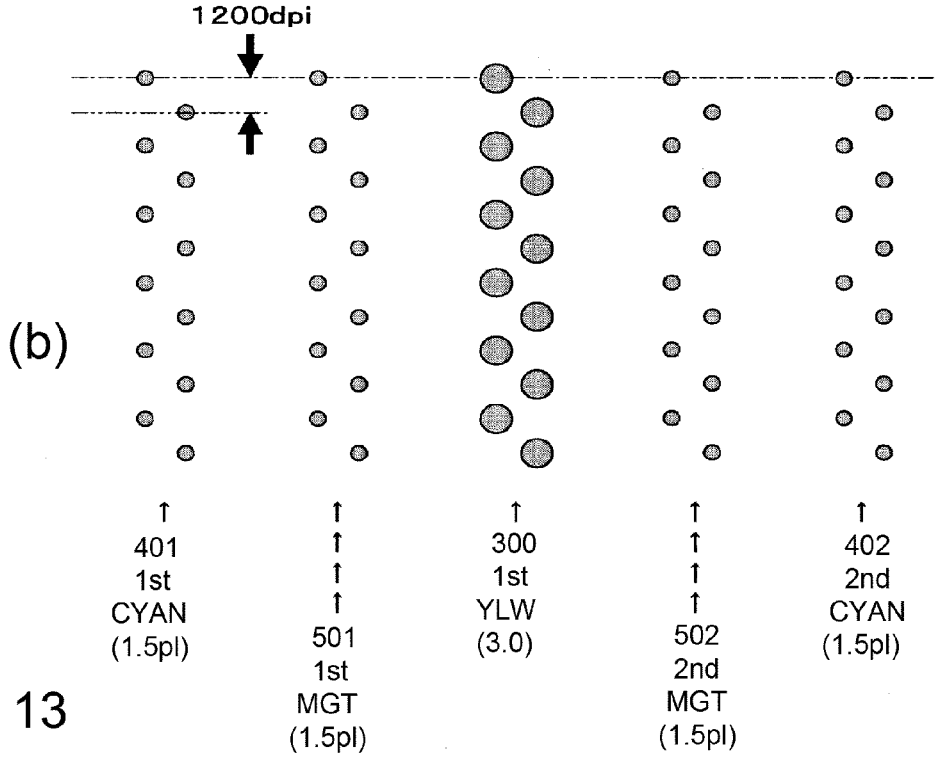

At this time, the structure of the recording head in this embodiment in terms of the arrangement of columns of nozzles will be described in detail, along with a modified version of the recording head in this embodiment, which also can offer the same effects as those offered by the recording head in this embodiment. In FIGS. 13, (*a*) and (*b*) show in detail the columns of nozzles shown in FIG. 12.

In the case of the nozzle arrangement shown in detail in (a) of FIG. 13, the nozzle pitch of each of the columns of nozzles which are smaller in ink droplet size, that is, the columns of nozzles for jetting cyan and magenta inks, is 2,400 dpi, as they are in the first embodiment, whereas in the case of the nozzle arrangement shown in detail in (b) of FIG. 13, the recording head is structured so that the corresponding nozzles, in terms of the direction parallel to the columns of nozzles, in the column 401 of nozzles for the first cyan ink, column 501 of nozzles for the first magenta ink, column 402 of nozzles for the second cyan ink, and column 502 of nozzles for the second magenta ink, align in the primary scan direction of the recording head.

In the case of the recording head in this embodiment, the pair of columns of larger nozzles is positioned in the center of the recording head, and the two pairs of columns of smaller nozzles are positioned on each side of the pair of columns of larger nozzles, in such a manner that the two sides become symmetrical in terms of ink color. Therefore, the order in which color inks are deposited on the recording paper when the recording head is moved in one direction is the same as the order in which color inks are deposited on the recording paper when the recording head is moved in the opposite direction. Therefore, even though the recording head is structured so that the corresponding nozzles in the first pair of columns of nozzles and the second pair of columns of nozzles align in the primary scan direction, the problem that even though the areas of an image printed while a recording head is moved in one direction is slightly different in tone from the areas of the image printed while the recording head is moved in the opposite direction, does not occur. In other words, this embodiment can afford more latitude in the nozzle placement in each column of nozzles than the first embodiment. Incidentally, in this embodiment, the droplet size of yellow ink, that is, the ink which is low in the visibility of the dots it forms when it is jetted for maintenance, is desired to be no more than roughly 4.5 pl as it is in the first embodiment. Further, from the standpoint of the visibility of the dots formed when the cyan and magenta inks are jetted for maintenance, the droplet size for cyan and magenta inks are desired to be no more than roughly 2.5 pl. However, the ink droplet size may be selected according to the performance of the ink, rate at which each ink bleeds on the recording paper, and the like factors. These are the features which characterize this embodiment, which is for providing a recording head capable of forming images which are satisfactorily low in the visibility of the dots formed by the ink droplets jetted for maintenance, satisfactorily high in image quality, and satisfactorily high in printing speed.

Embodiment 3

Next, another embodiment of the present invention, which can further improve a recording head in terms of the quality of a photographic image, that is, an image required to be more precise in detail, will be described.

In FIGS. 14, (*a*) and (*b*) are drawings for describing the third preferred embodiment of the present invention. More specifically, they are schematic plan views of the surface of the second recording chip H1101 in this embodiment of the present invention, as seen from the side where nozzle openings are located. They show the ink droplet size, and the order in which the columns of nozzles for various inks different in color are positioned. This embodiment also is the same as the first embodiment except for the nozzle column arrangement, as is the second embodiment.

In FIG. 14, (*a*) is a plan view of the surface of the second recording chip H1101 in this embodiment, as seen from the side where nozzle openings are located. This recording chip has two pairs of columns of nozzles for the black ink, in addition to the same ink columns of nozzles as those of the recording chip in the second embodiment. The black ink used by this recording chip is dye-based black ink for forming photographic images. The size of the dye-based black ink jetted from the columns 601 and 602 of nozzles for the black ink is roughly 1.5 pl. The nozzle count of each column of nozzles for the black ink is the same as the nozzle count of each column of nozzles of the recording chip in the first embodiment. The first recording chip H1100 in this embodiment uses pigment-based black ink. However, the pigment-based black ink is unlikely to permeate into such recording paper as coated paper, high gloss paper, etc., which were specifically created for recording high quality images, for example, photographic images. Therefore, when the recording head in this embodiment is used for recording on recording medium for high quality images, pigment-based black ink is not used. That is, when recording photographic images, black color is composed by mixing color inks (so-called composite black). If a recording chip is structured like the one in this embodiment, black-and-white images can be printed at an appropriate level of density, on a sheet of ordinary paper, by the pigment-based black ink for which a pair of black ink columns of nozzles is provided. In addition, the dye-based ink can be used when printing photographic images on a sheet of recording paper for high quality images. The usage of dye-based inks along with the recording chip in this embodiment can yield photographic images which are higher in density and contrast. In other words, this embodiment makes it possible to print images of higher quality at a higher speed than a recording chip in accordance with the prior art.

In FIG. 14, (*b*) is a plan view of the surface of a modified version of the second recording chip H1101 in this embodiment, as seen from the side where nozzle openings are located. This recording chip has two pairs of columns of nozzles for jetting dye-based black ink, two pairs of columns of nozzles for jetting light cyan ink, and two pairs of columns of nozzles for jetting light magenta ink, in addition to the columns of nozzles which the recording chip in the second embodiment has. The light cyan ink and light magenta ink used in this embodiment are such cyan and magenta inks that are roughly ⅓-⅙ in density. The size of an ink droplet jetted from the columns 601 and 602 of the nozzles for dye-based black ink is roughly 1.5 pl, and the size of an ink droplet jetted from the columns 400 and 500 of the nozzles for light cyan ink and light magenta ink, respectively, is roughly 3.0 pl. Also shown in Table 1 are the visibility level of the dots formed by the light cyan ink droplets, and that of the dots formed by the light magenta ink droplets, indicating that the dots formed by the inks of light color (inclusive of yellow ink) tend to reduce in visibility as they are reduced in density. Therefore, the droplet size in which the inks of light color are jetted may be larger compared to the droplet size in which inks of dark color, such as cyan, magenta, dye-based black ink, etc., which are higher in visibility, (conspicuous) are jetted. Incidentally, the light cyan ink and light magenta ink used by the recording chip in this embodiment are no more than 1.4% in the weight-based density of coloring material. By determining the dot size for the light inks for printing images of high quality, based on the visibility of the dots formed by the ink droplets jetted for maintenance, as in this embodiment, it is possible to print high quality images at a high speed while jetting ink droplets for maintenance, that is, the ink droplets which are not intended for image formation, on a sheet of recording paper.

Figure 15:
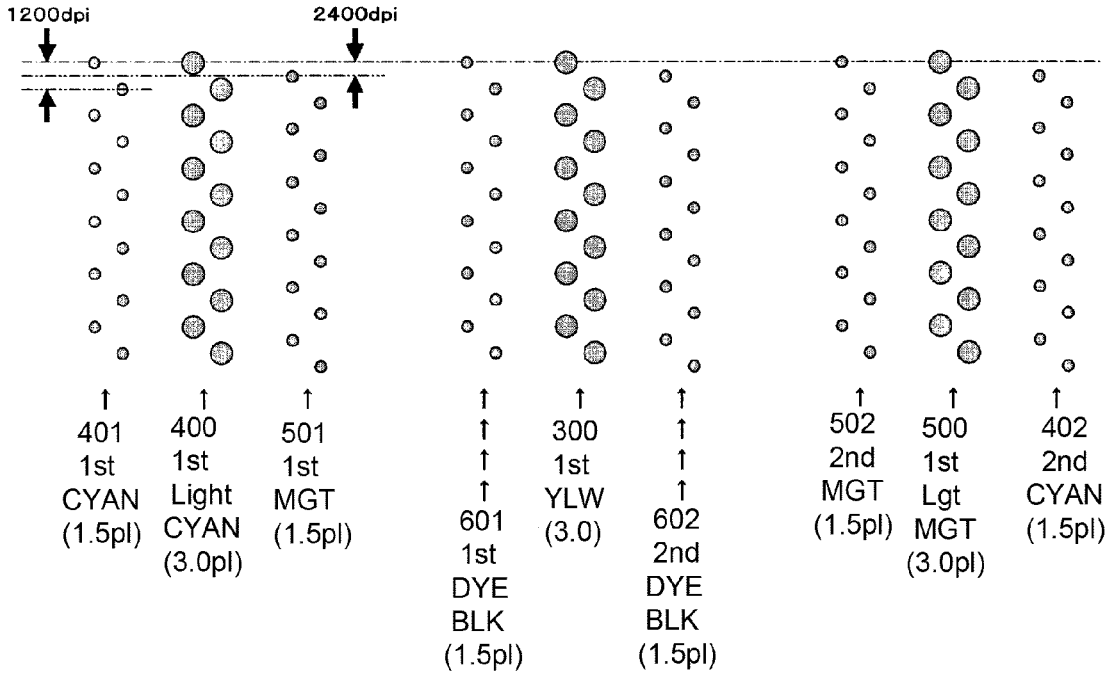
FIG. 15 is a detailed view of the surface of the recording chip, at which the nozzle openings are located, in the third embodiment of the present invention, showing in detail the arrangement of the columns of nozzles.

In FIG. 14, (*b*) shows the recording head in this embodiment, which has three second recording chips H1101 arranged side by side. There is a tendency that the greater the number of columns of nozzles per recording chip, the lower the yield of recording chip. However, structuring a recording chip as it is in this embodiment makes it unnecessary to significantly increase the number of columns of nozzles per recording chip, being therefore less likely to reduce the recording chip yield. Further, referring to FIG. 15, in this embodiment, the recording head is provided with three second recording chips H1101, and each of the three recording chips H1101 is provided with three pairs of columns of nozzles. Moreover, one column of nozzles of each of the lateral pairs of columns of nozzles of each recording chip H1101 is displaced relative to the other columns of nozzle, in the direction parallel to the columns of nozzles, by a distance equal to ½ the nozzle interval of the column, that is, a distance equivalent to 2,400 dpi, making it possible to form dots at a resolution of 2,400 dpi when inks of light color, that is, the inks to be jetted in a smaller droplet size, are jetted. Further, the three second recording chips H1101 are arranged in parallel without being deviated relative to each other in the direction parallel to the columns of nozzles. Thus, this embodiment makes it possible to select the ink droplet size of the second recording chip, according to the visibility of the dots formed by the ink droplets jetted for maintenance, that is, the ink droplets which are not intended for image formation. It also makes it possible to provide a recording head, the columns of nozzles of which are symmetrically arranged, as those of the recording head in the second embodiment, to reduce the occurrence of tone deviation.

Recording head cartridge structured as described above was evaluated in terms of the visibility of the dots formed by the ink droplets jetted for maintenance. The evaluation method is the same as the one described above. The evaluation was "G" with reference to the evaluation standard described above, for all the dots formed on a sheet of recording paper using inks of all colors and densities. Further, the images of test patterns printed immediately after the completion of a maintenance operation were all satisfactory, indicating that erroneous jetting of ink did not occur.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 334467/2007 filed Dec. 26, 2007, which is hereby incorporated by reference herein.

What is claimed is:

1. An ink jet recording head comprising:

a large nozzle array including a plurality of ejection outlets for ejecting ink; and a small nozzle array including a plurality of ejection outlets each having an opening area smaller than an opening area of the ejection outlets of said large nozzle array, wherein said ink jet recording head is mountable to an ink jet recording apparatus which is capable of causing said ink jet recording head to eject ink for a purpose of maintenance of said ink jet recording head without image formation on a recording material, wherein said large nozzle array is supplied with light ink including yellow, light cyan or light magenta ink, and said small nozzle array is supplied with dark ink including cyan, magenta or black ink, and wherein, for the maintenance, the number of ejections of the dark ink is greater than the number of ejections of the light ink, and wherein, for the maintenance, a product of a volume of an ink droplet ejected from an ejection outlet of said large nozzle array and the number of ejections of the light color ink is substantially the same as a product of a volume of an ink droplet ejected from an ejection outlet of said small nozzle array and the number of ejections of the dark color ink.

2. An ink jet recording head according to Claim 1, wherein plural small nozzle arrays are provided at positions symmetrical with respect to said large nozzle array in a main scan direction in which said ink jet recording head scans the recording material.

3. An ink jet recording apparatus comprising:

an jet recording head according to claim 1; and a controller for controlling an ejecting operation for the maintenance and for an image forming operation.

4. An apparatus according to claim 3, wherein the ejecting operation for the maintenance is effected such that ink dots formed adjacent to each other are not overlaid with respect to a main scan direction or a direction in which a nozzle array extends.

* * * * *